US006196736B1

(12) United States Patent
Otsuki et al.

(10) Patent No.: US 6,196,736 B1
(45) Date of Patent: Mar. 6, 2001

(54) ADJUSTMENT OF PRINTING POSITION DEVIATION DURING BIDIRECTIONAL PRINTING

(75) Inventors: Koichi Otsuki; Shuji Yonekubo; Kazushige Tayuki; Toyohiko Mitsuzawa, all of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/374,845

(22) Filed: Aug. 16, 1999

(30) Foreign Application Priority Data

Aug. 18, 1998 (JP) ..... 10-249137
Feb. 10, 1999 (JP) ..... 11-32163

(51) Int. Cl.[7] ..... B41J 2/22

(52) U.S. Cl. ..... 400/124.01; 400/279; 347/19; 347/14

(58) Field of Search ..... 400/279, 323, 400/124.01, 53, 74; 347/12, 13, 17–19, 37, 40, 41, 42, 43

(56) References Cited

U.S. PATENT DOCUMENTS

| | | | | |
|---|---|---|---|---|
| 5,353,052 | * | 10/1994 | Suzuki et al. | 347/19 |
| 5,534,895 | | 7/1996 | Lindenfelser et al. . | |
| 5,596,353 | * | 1/1997 | Takada et al. | 347/19 |
| 5,610,639 | * | 3/1997 | Takada et al. | 347/19 |
| 5,736,996 | * | 4/1998 | Takada et al. | 347/19 |
| 5,797,690 | * | 8/1998 | Iwamura et al. | 400/124.01 |
| 5,838,342 | * | 11/1998 | Takahashi et al. | 347/19 |
| 5,946,006 | * | 8/1999 | Tajika et al. | 347/19 |
| 5,997,123 | * | 12/1999 | Takekoshi et al. | 347/14 |
| 6,000,776 | * | 12/1999 | Suzuki et al. | 347/19 |
| 6,027,201 | * | 2/2000 | Edge | 347/19 |
| 6,076,915 | * | 6/2000 | Gast et al. | 347/19 |
| 6,109,721 | * | 8/2000 | Kim | 347/19 |
| 6,116,714 | * | 9/2000 | Imanake et al. | 347/19 |
| 6,126,264 | * | 10/2000 | Suzuki et al. | 347/19 |

FOREIGN PATENT DOCUMENTS

| | | |
|---|---|---|
| 0 610 096 | 8/1994 | (EP) . |
| 0 622 229 | 11/1994 | (EP) . |
| 5-69625 | 3/1993 | (JP) . |

OTHER PUBLICATIONS

U.S. application No. 09/588,712, filed Jun. 7, 2000, pending.
U.S. application No. 09/497,177, filed Feb. 3, 2000, pending.
U.S. application No. 09/497,168, filed Feb. 3, 2000, pending.
U.S. application No. 09/445,446, filed Dec. 14, 1999, pending.
U.S. application No. 09/461,396, filed Dec. 15, 1999, pending.
U.S. application No. 09/461,620, filed Dec. 15, 1999, pending.
U.S. application No. 09/461,307, filed Dec. 15, 1999, pending.
U.S. application No. 09/228,969, filed Jan. 12, 1999, pending.
U.S. application No. 09/245,844, filed Feb. 8, 1999, pending.
U.S. application No. 09/366,596, filed Aug. 3, 1999, pending.

* cited by examiner

*Primary Examiner*—Eugene Eickholt
(74) *Attorney, Agent, or Firm*—Oblon, Spivak, McClelland, Maier & Neustadt, P.C.

(57) ABSTRACT

Image quality is improved by correcting printing position deviation arising between forward and reverse passes in the main scanning direction during bidirectional printing. An adjustment value is prepared with respect to at least one type of specific target dots other than those dots having the highest density out of the plural types of dots. Printing positions during forward and reverse main scanning passes are adjusted with the adjustment value to reduce printing positional deviation between forward and reverse main scanning passes.

21 Claims, 29 Drawing Sheets

| HEAD ID | Δ (μm) |
|---|---|
| 1 | −35.0 |
| 2 | −17.5 |
| 3 | 0 |
| 4 | +17.5 |

TEST PATTERN FOR DETERMINING REFERENCE CORRECTION VALUE

Fig. 18(A) NO ADJUSTMENT
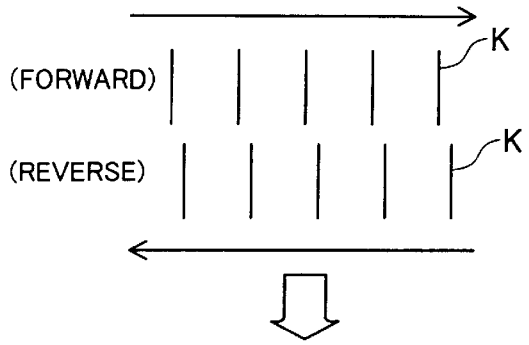
Fig. 18(B)
ADJUSTMENT WITH REFERENCE CORRECTION VALUE (K ONLY)
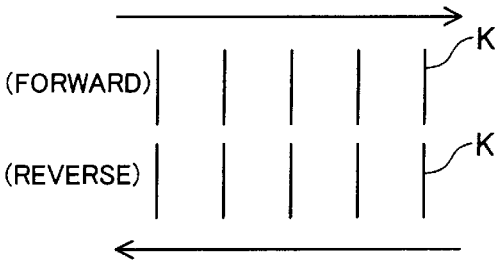
Fig. 18(C)
ADJUSTMENT WITH REFERENCE CORRECTION VALUE (K + C)
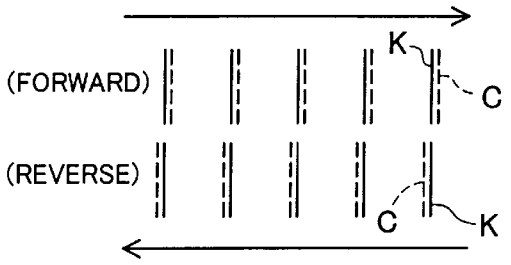
Fig. 18(D)
ADJUSTMENT WITH REFERENCE AND RELATIVE CORRECTION VALUES (K + C)
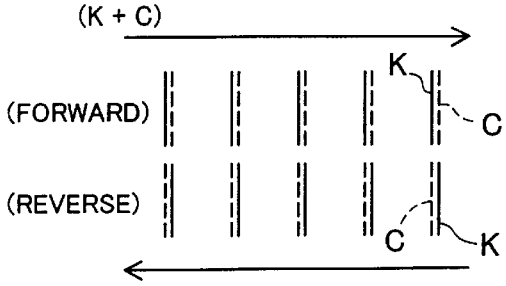
K DOTS AND C DOTS ARE TARGET OF POSITIONAL CORRECTION (RELATIVE CORRECTION VALUE $\Delta = -\delta c$)

Fig. 19(A) NO ADJUSTMENT
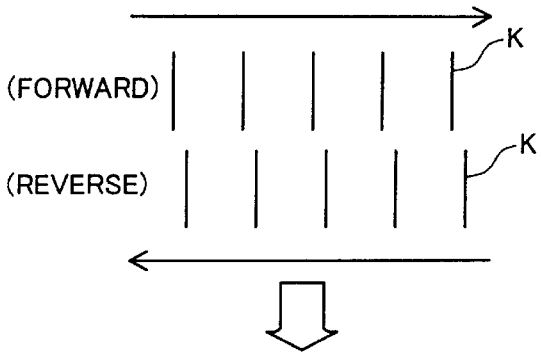
Fig. 19(B)
ADJUSTMENT WITH REFERENCE CORRECTION VALUE (K ONLY)
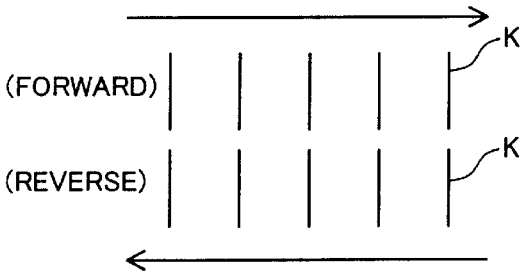
Fig. 19(C)
ADJUSTMENT WITH REFERENCE CORRECTION VALUE (K + C)
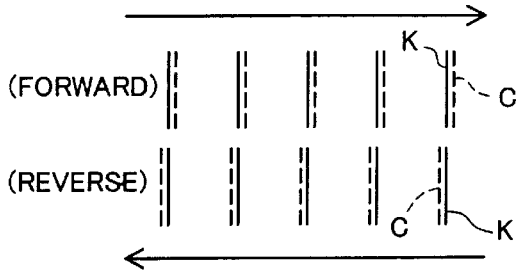
Fig. 19(D)
ADJUSTMENT WITH REFERENCE AND RELATIVE CORRECTION VALUES (K + C)
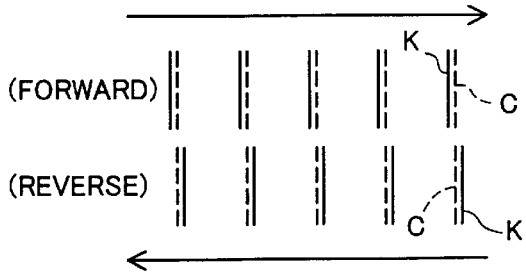
C DOTS ARE TARGET OF POSITIONAL CORRECTION (RELATIVE CORRECTION VALUE $\Delta = -2\delta c$)

BASE DRIVE SIGNAL IN THIRD EMBODIMENT

TEST PATTERN FOR DETERMINING RELATIVE CORRECTION VALUE

RELATIVE CORRECTION VALUE FOR SMALL DOT: $\Delta S = (\delta S - \delta L)$

RELATIVE CORRECTION VALUE FOR MEDIUM DOT: $\Delta M = (\delta M - \delta L)$

NO ADJUSTMENT (LARGE DOT)

ADJUSTMENT WITH REFERENCE CORRECTION VALUE (LARGE DOT ONLY)

ADJUSTMENT WITH REFERENCE CORRECTION VALUE (LARGE AND SMALL DOTS)

ADJUSTMENT WITH REFERENCE AND RELATIVE CORRECTION VALUES (LARGE AND SMALL DOTS)

SMALL DOTS ARE TARGET OF POSITIONAL CORRECTION

Fig. 29(a-1)
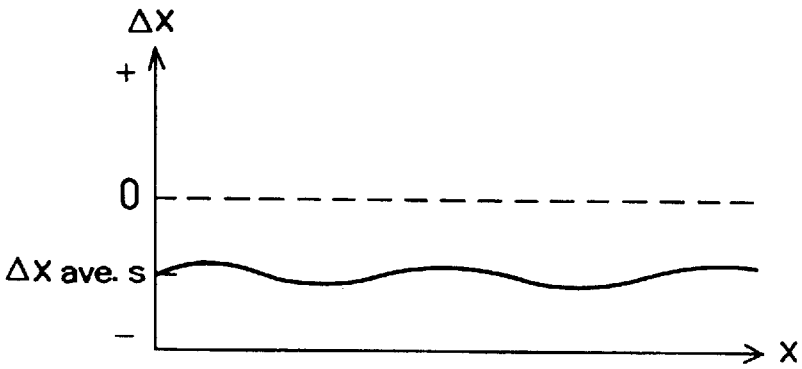
Fig. 29(a-2)
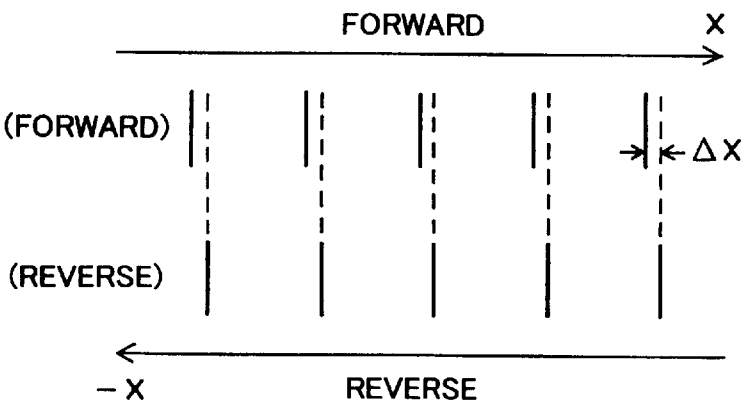
Fig. 29(b-1)
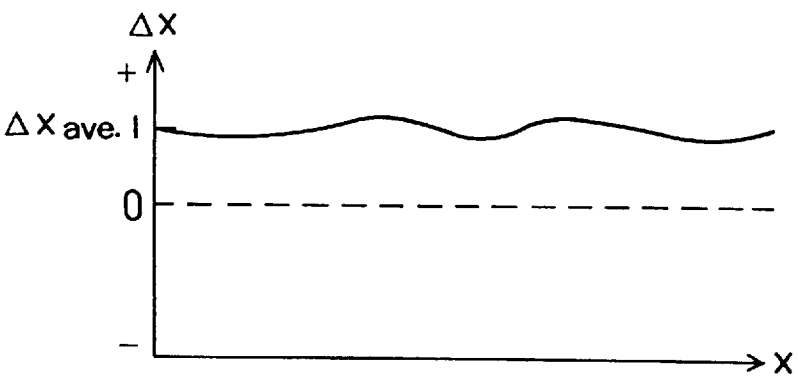
Fig. 29(b-2)
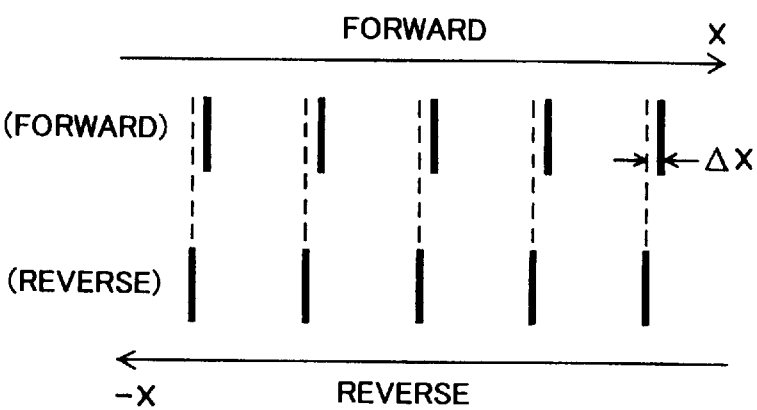

DEVIATION ΔX BETWEEN FORWARD AND REVERSE PASSES
ΔX
+
0
−
0 L1 L2 L3 L4 Lmax X

IDEAL CORRECTION VALUE δ
δ
+
0
−
0 L1 L2 L3 L4 Lmax X

DRIVE SIGNAL FREQUENCY $f_{DRV}$
$f_{DRV}$(KHz)
f3
f2
f1
0 L1 L2 L3 L4 Lmax X
R1 R2 R3 R4 R5

FORWARD X
ΔX
(FORWARD)
(REVERSE)
REVERSE
-X

FORWARD X
REVERSE
-X

ADJUSTMENT OF PRINTING POSITION DEVIATION DURING BIDIRECTIONAL PRINTING

BACKGROUND OF THE INVENTION

1. Field of the Invention

This invention relates to a technology for printing on print media using a bidirectional reciprocating movement in a main scanning direction. The invention particularly relates to a technology for correcting printing position deviation between forward and reverse passes.

2. Description of the Related Art

In recent years color printers that emit colored inks from a print-head are coming into widespread use as computer output devices. In recent years, such color printers have been devised as multilevel printers able to print each pixel using a plurality of dots having different sizes. Such printers use relatively small ink droplets to form relatively small dots within a pixel region, and relatively large ink droplets to form relatively large dots within a pixel region. These printers can also print bidirectionally to increase the printing speed.

A problem that readily arises in bidirectional printing is that of deviation in printing position between forward and reverse printing passes in the main scanning direction caused by backlash in the main scanning drive mechanism and warping of the platen that supports the print media. JP-A-5-69625 is an example of a technology disclosed by the present applicants for solving this problem of positional deviation. This comprises of registering beforehand the printing deviation amount in the main scanning direction and using this printing deviation amount as a basis for correcting the positions at which dots are printed during forward and reverse passes.

However, in the case of bidirectional printing using multilevel printers, little consideration has been given to positional deviation arising between forward and reverse printing passes. Other problems include that while deviation may be corrected with respect to a particular one of the multiple colored inks, there is no correction of deviation in other ink colors. As a result, the deviation correction provides little improvement in the quality of the color image. The effect that positional deviation has on image quality is particularly large in middle tone regions.

SUMMARY OF THE INVENTION

Accordingly, an object of the present invention is to improve image quality by alleviating printing position deviation arising between forward and reverse passes in the main scanning direction during bidirectional printing.

In order to attain at least one of the above and other objects of the present invention, an adjustment value is prepared with respect to at least one type of specific target dots other than those dots having the highest density out of the plural types of dots; and printing positions during forward and reverse main scanning passes are adjusted with the adjustment value to reduce printing positional deviation between forward and reverse main scanning passes.

The target dots, which have a relatively low density, occur with a high frequency in middle tone regions. It therefore follows that if during bidirectional printing positional deviation is adjusted by using an adjustment value for the target dots, positional deviation in middle tone regions in particular can be alleviated, improving image quality.

When the print head is able to print dots in each of M types of inks where M is an integer of at least two, the target dots may be formed of specific inks having a relatively low density out of the M types of inks. The printing positions are adjusted using the adjustment value relating to the target dots in color printing using two or more of the M types of inks. In this case, by selecting as the target dots, dots formed using ink that tend to make positional deviation more noticeable, it is possible to reduce the positional deviation of such target dots and thereby improve the quality of the color images.

When the M types of inks include at least one pair of dark and light inks having substantially the same hue and different densities, the target dots are preferably formed of the light ink. Considerable use is made of such light inks particularly in middle tone regions. It therefore follows that if during bidirectional printing positional deviation is adjusted by using an adjustment value for dots formed using light inks, positional deviation in middle tone regions in particular can be alleviated, improving image quality.

When the M types of inks include a pair of dark and light inks for each of cyan and magenta, the target dots preferably include first target dots formed of light cyan ink and second target dots formed of light magenta ink. In this case, the adjustment value is preferably determined such that a positional deviation of the first target dots and a positional deviation of the second target dots become substantially equal. Since considerable use is made of light cyan and light magenta inks in middle tone regions in particular, image quality of middle tone regions can be improved by determining adjustment values whereby the positional deviation of dots formed using those inks becomes substantially the same.

When the print head can print N types of dots of different sizes in at least one type of ink where N is an integer of at least 2, the target dots preferably include at least one type of relatively small dots other than the largest among the N types of dots. In this case, the adjustment value with respect to the relatively small target dots may be applied in common to the N types of dots. The target dots may be those that are medium sized of the N types of dots. Of the N types of dots, positional deviation of medium sized dots stands out in middle tone regions. It therefore follows that by taking a common deviation adjustment value relating to such target dots and applying the value as a common value to the N types of dots, positional deviation between forward and reverse passes in the main scanning direction can be made less noticeable, thereby improving the image quality.

The target dots may be dots that are used in the greatest numbers when the printing image signal indicates a density level of 50% in respect of ink used to form the target dots. In middle tone regions positional deviation tends to be more noticeable when the dots are those that are most used when print image signals indicate a 50% density level. Thus, image quality in middle tone regions can be improved by using an adjustment value for such target dots.

The timing of the generated drive signal pulses may be adjusted during at least one selected from a forward pass and a reverse pass to reduce positional deviation in a main scanning direction between target dots printed during the forward and reverse passes. Specifically, the timing of the generated drive signal pulses can be adjusted by delaying the drive signal during at least one selected from a forward pass and a reverse pass. Alternatively, the timing of the generated drive signal pulses can be adjusted by changing the frequency of the drive signal in accordance with a position in the main scanning direction, with the frequency adjustment taking place during at least one selected from a forward pass and a reverse pass.

The present invention can be embodied in various forms such as a printing method, a printing apparatus, a computer program that has the functions of the method or of the apparatus, a computer readable medium on which is recorded the computer program, and a data signal embodied in a carrier wave comprising the computer program.

These and other objects, features, aspects, and advantages of the present invention will become more apparent from the following detailed description of the preferred embodiments with the accompanying drawings.

BRIEF DESCRIPTION OF THE DRAWINGS

FIGS. 18(A)–18(D) illustrate the correction of positional deviation using reference and relative correction values, when black dots and cyan dots have been selected as the target dots.

FIGS. 19(A)–19(D) illustrate the correction of positional deviation using reference and relative correction values, when only cyan dots have been selected as the target dots.

FIGS. 29(*a*-1), 29(*a*-2), 29(*b*-1), and 29(*b*-2) show the distribution of the deviation in printing positions in respect of small and medium dots printed during forward and reverse passes.

DESCRIPTION OF THE PREFERRED EMBODIMENT

The preferred embodiments of the present invention will be explained in the following order.

A. Apparatus configuration:

B. Generation of printing positional deviation between nozzle rows:

C. First embodiment (correction of positional deviation between nozzle rows (1)):

D. Second embodiment (correction of positional deviation between nozzle rows (2)):

E. Third embodiment (correction of positional deviation between dots of different sizes (1)):

F. Fourth embodiment (correction of positional deviation between dots of different sizes (2)):

G. Fifth embodiment (adjustment of positional deviation by drive signal frequency):

H. Modifications:

The embodiments described below are various examples for achieving that which characterizes this invention, which is adjustment of printing positional deviation arising during bidirectional printing by determining an adjustment value for adjusting printing positional deviation during bidirectional printing, the adjustment value relating at least to a specific target dot other than those dots that out of a plurality of dots having differing densities have the highest density. There are various ways to interpret "dots that out of a plurality of dots having differing densities have the highest density." For example, in cases where the dots can be formed in different sizes using one ink, the largest dots can mean the dots having the highest density. In this case, as the dots that are targeted for adjustment of positional deviation, there can be selected dots that are smaller than the largest dots. In cases where multiple colored inks including black are used in color printing, the black ink dots can mean the dots having the highest density. In this case, as the target dots, there can be selected dots formed of ink other than black ink. In the embodiments and the modifications described below, it should be noted that for convenience examples are also described that do not provide the characterizing effect of the invention.

Figure 1:
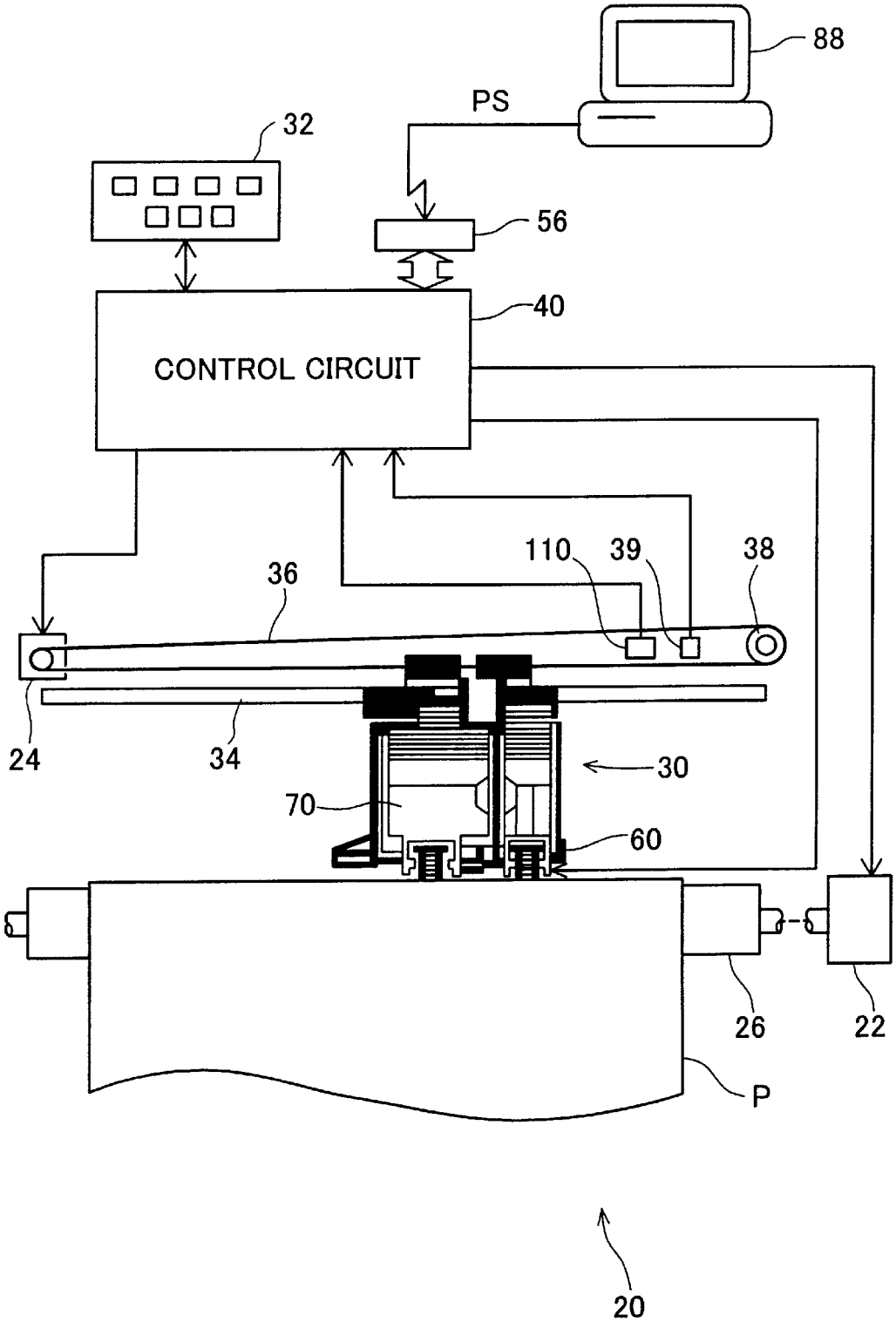
FIG. 1 shows the general configuration of a printing system equipped with the printer 20 of the first embodiment.

A. Apparatus configuration:

FIG. 1 shows the general configuration of a printing system provided with an inkjet printer 20, constituting a first embodiment of the invention. The inkjet printer 20 includes a sub-scanning feed mechanism that uses a paper feed motor 22 to transport the printing paper P, a main scanning mechanism that uses a carriage motor 24 to effect reciprocating movement of a carriage 30 in the axial (main scanning) direction of a platen 26, a head drive mechanism that drives a print head unit 60 (also referred to as a print head assembly) mounted on the carriage 30 and controls ink emission and dot formation, and a control circuit 40 that controls signal traffic between a control panel 32 and the feed motor 22, the carriage motor 24 and the print-head unit 60. The control circuit 40 is connected to a computer 88 via a connector 56.

The sub-scanning feed mechanism that transports the paper P includes a gear-train (not shown) that transmits the rotation of the feed motor 22 to the platen 26 and to paper transport rollers (not shown). The main scanning mechanism that reciprocates the carriage 30 includes a slide-shaft 34 that slidably supports the carriage 30 and is disposed parallel to the shaft of the platen 26, a pulley 38 connected to the carriage motor 24 by an endless drive belt 36, and a position sensor 39 for detecting the starting position of the carriage 30.

Figure 2:
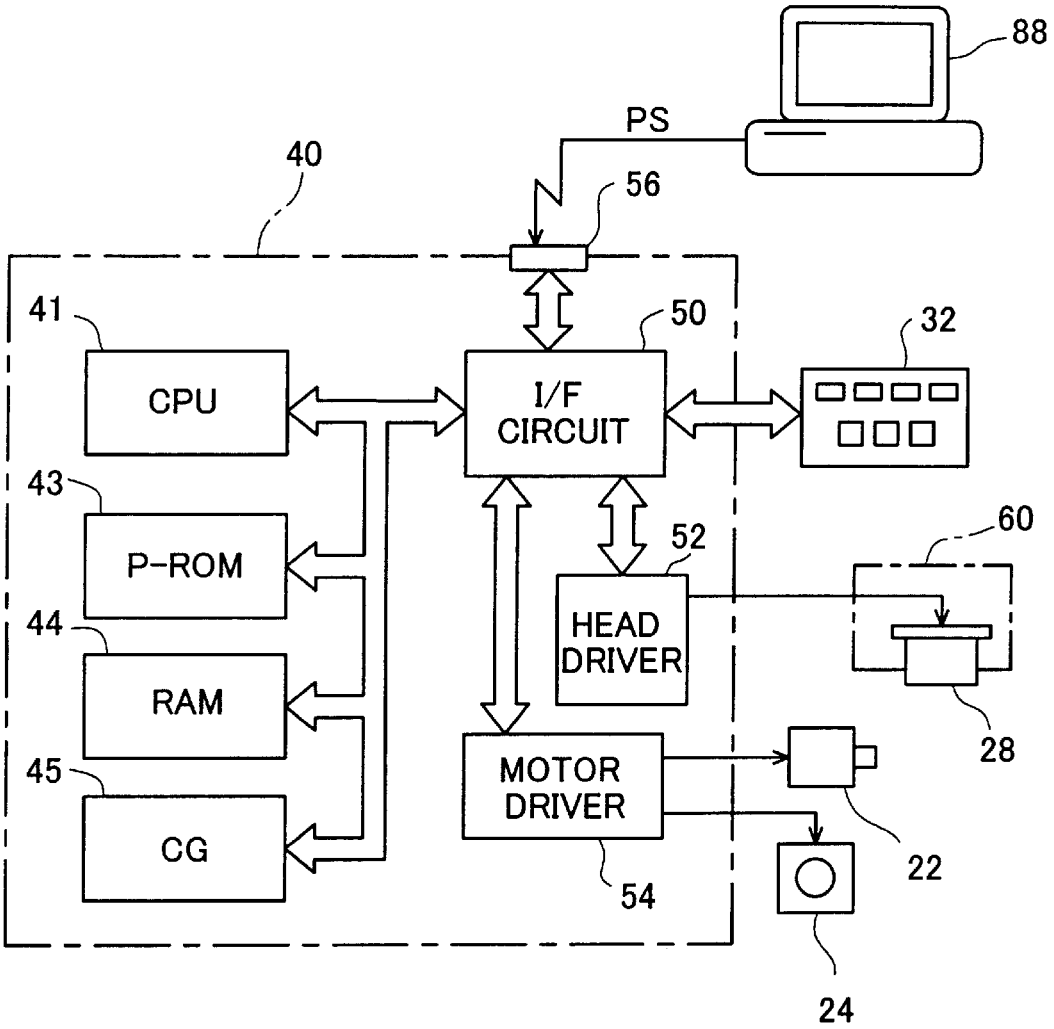
FIG. 2 is a block diagram showing the configuration of the control circuit 40 of the printer 20.

FIG. 2 is a block diagram showing the configuration of the inkjet printer 20 centering on the control circuit 40. The control circuit 40 is configured as an arithmetical logic processing circuit that includes a CPU 41, a programmable ROM (PROM) 43, RAM 44, and a character generator (CG) 45 in which is stored a character matrix. The control circuit 40 is also provided with an interface (I/F) circuit 50 for interfacing with an external motor and the like, a head drive circuit 52 that is connected to the I/F circuit 50 and drives the print head unit 60 to emit ink, and a motor drive circuit 54 that drives the feed motor 22 and the carriage motor 24. The I/F circuit 50 incorporates a parallel interface circuit and, via the connector 56, can receive print signals PS from the computer 88.

Figure 3:
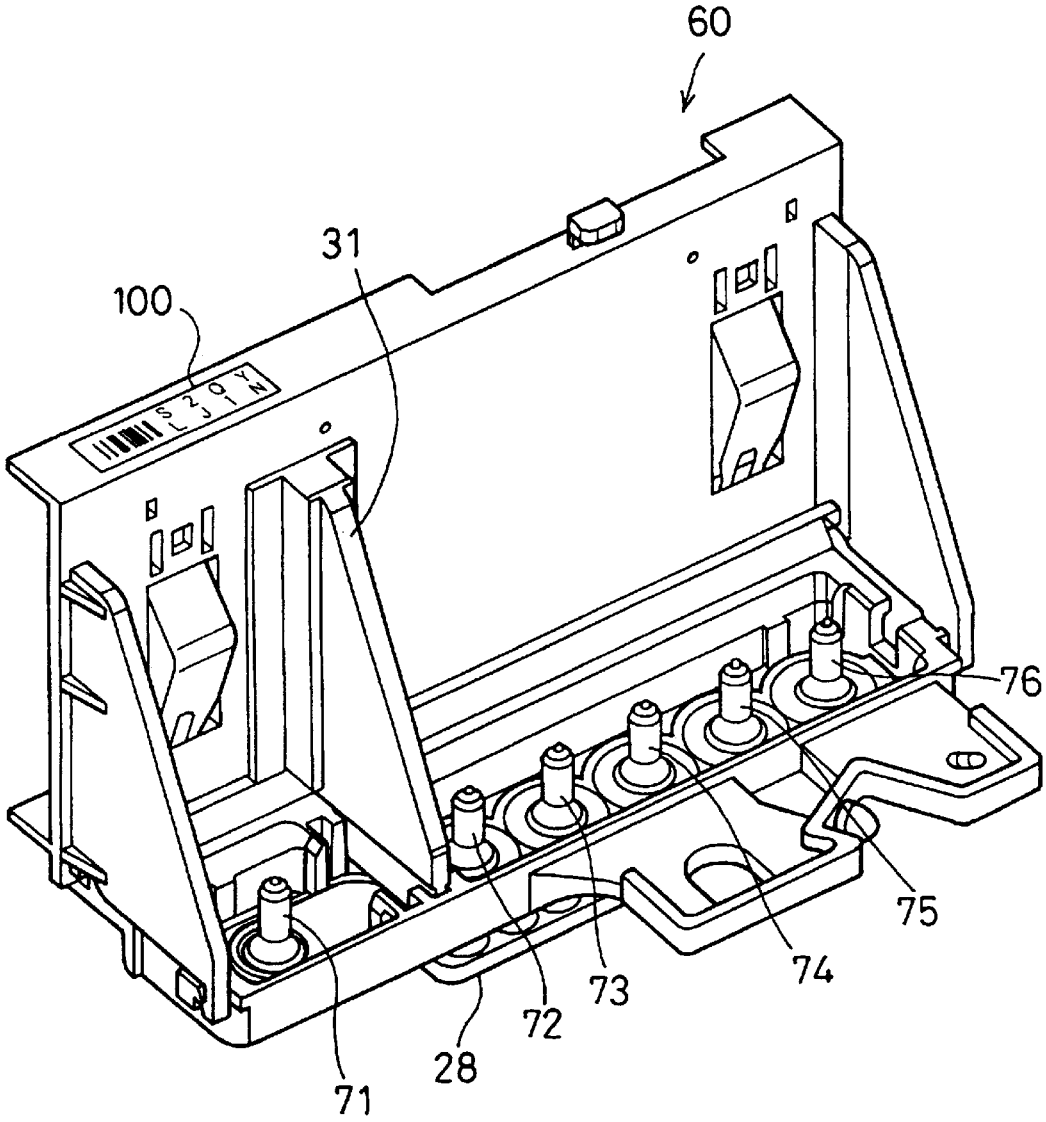
FIG. 3 is a perspective view of the print head unit 60.

FIG. 3 is a diagram illustrating a specific configuration of the print head unit 60. As can be seen, the print head unit 60 is L-shaped, and can hold black and colored ink cartridges (not shown). The print head unit 60 is provided with a dividing plate 31 to allow both cartridges to be installed.

An ID seal 100 is provided on the top edge of the print head unit 60. The ID seal 100 displays the head identification information pertaining to the print head unit 60. Details of the information provided by the ID seal 100 will be described later.

The print head unit 60 constituted by the print head 28 and the ink cartridges is so called because it is removably installed in the inkjet printer 20 as a single component. That is, when a print head 28 is to be replaced, it is the print head unit 60 itself that is replaced.

The bottom part of the print head unit 60 is provided with ink channels 71 to 76 via which ink from ink tanks is supplied to the print head 28. When black and colored ink cartridges are installed by being pressed down onto the print head unit 60, the ink channels 71 to 76 are inserted into the respective cartridges.

Figure 4:
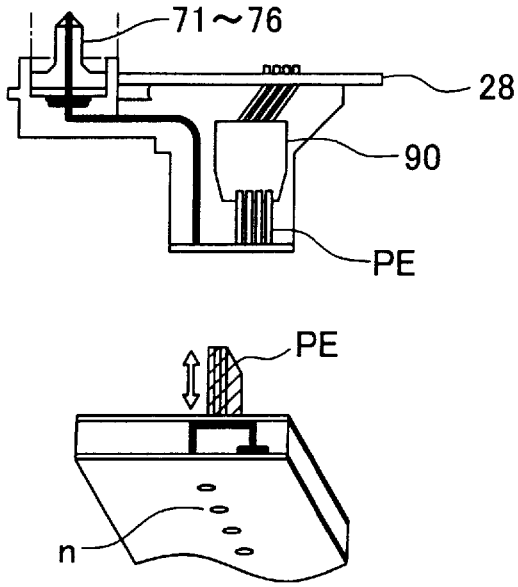
FIG. 4 illustrates the ink emission mechanism of the print head.

FIG. 4 illustrates the mechanism to emit ink. When an ink cartridge is installed on the print head unit 60, ink from the cartridge is drawn out via the ink channels 71 to 76 and channeled to the print head 28 provided on the underside of the print head unit 60.

For each color, the print head 28 has a plurality of nozzles n arranged in a line, and an actuator circuit 90 for activating a piezoelectric element PE with which each nozzle n is provided. The actuator circuit 90 is a part of the head drive circuit 52 (FIG. 2), and controls the switching on and off drive signals supplied from a drive signal generator (not shown). Specifically, for each nozzle, in accordance with a print signal PS supplied from the computer 88 the actuator circuit 90 is latched on (ink is emitted) or off (ink is not emitted), and applies a drive signal to piezoelectric elements PE only in respect of nozzles that are switched on.

Figure 5A:
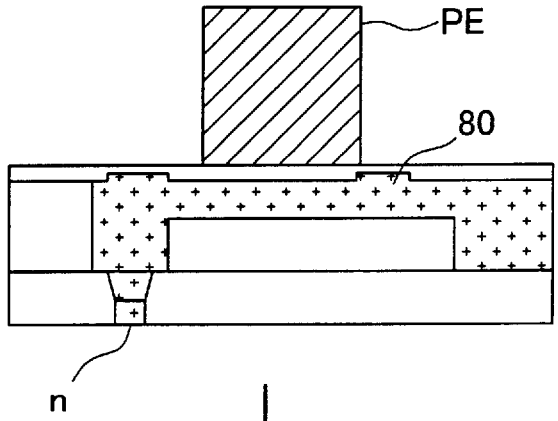
FIGS. 5(A) and 5(B) illustrate the arrangement whereby ink particles Ip are emitted by the expansion of a piezoelectric element PE.
Figure 5B:
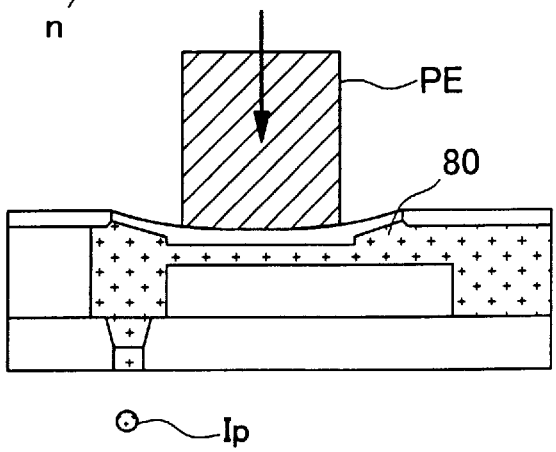

FIGS. 5(A) and 5(B) illustrate the principle based on which a nozzle n is driven by the piezoelectric element PE. The piezoelectric element PE is provided at a position where it is in contact with an ink passage 80 via which ink flows to the nozzle n. In this embodiment, when a voltage of prescribed duration is applied across the electrodes of the piezoelectric element PE, the piezoelectric element PE rapidly expands, deforming a wall of the ink channel 80, as shown in FIG. 5(B). This reduces the volume of the ink channel 80 by an amount corresponding to the expansion of the piezoelectric element PE, thereby expelling a. corresponding amount of ink in the form of a particle Ip that is emitted at high speed from the nozzle n. Printing is effected by these ink particles Ip soaking into the paper P on the platen 26.

Figure 6:
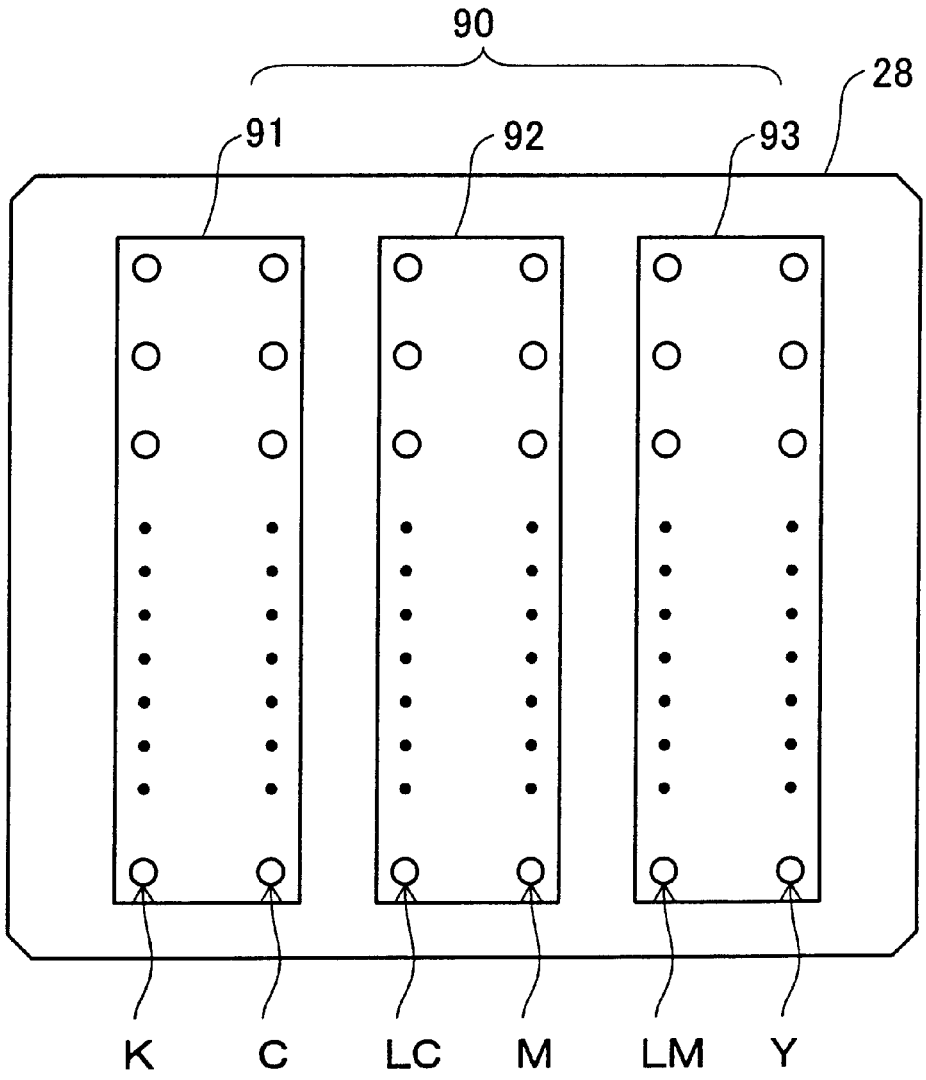
FIG. 6 is a diagram illustrating the positional relationship between the rows of nozzles in the print head 28 and the actuator chips.

FIG. 6 is a diagram illustrating the positional relationship between the rows of nozzles in the print head 28 and the actuator chips. The inkjet printer 20 prints using inks of the six colors black (K), dark cyan (C), light cyan (LC), dark magenta (M), light magenta (LM) and yellow (Y), and has a row of nozzles for each color. Dark cyan and light cyan are cyan inks of different density having more or less the same hue. This is also the case with respect to dark magenta and light magenta.

The actuator circuit 90 is provided with a first actuator chip 91 that drives the row of black ink nozzles K and the row of dark cyan ink nozzles C, a second actuator chip 92 that drives the row of row of light cyan ink nozzles LC and the row of dark magenta ink nozzles M, and a third actuator chip 93 that drives the row of light magenta ink nozzles LM and the row of yellow ink nozzles Y.

Figure 7:
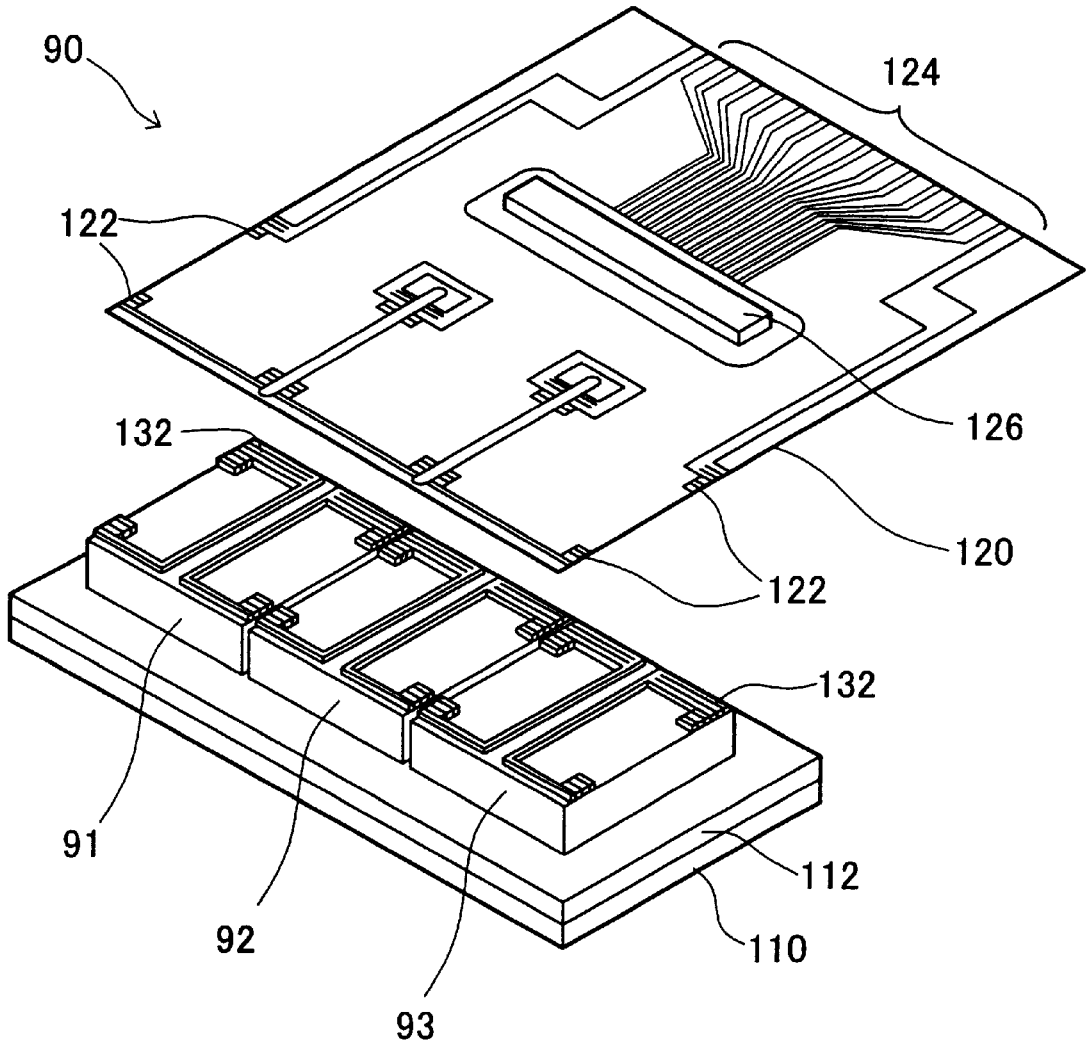
FIG. 7 is an exploded perspective view of the actuator circuit 90.

FIG. 7 is an exploded perspective view of the actuator circuit 90. Using adhesive, the three actuator chips 91 to 93 are bonded to the top of a laminated assembly comprised of a nozzle plate 110 and a reservoir plate 112. A contact terminal plate 120 is affixed over the actuator chips 91–93. Formed on one edge of the contact terminal plate 120 are terminals 124 for forming electrical connections with an external circuit (specifically the I/F circuit 50 of FIG. 2). Provided on the underside of the contact terminal plate 120 are internal contact terminals 122 for connecting the actuator chips 9110 93. A driver IC 126 is provided on the contact terminal plate 120. The driver IC 126 has circuitry for latching print signals supplied from the computer 88, and an analogue switch for switching drive signals on and off in accordance with the print signals. The connecting wiring between the driver IC 126 and the terminals 122 and 124 is not shown.

Figure 8:
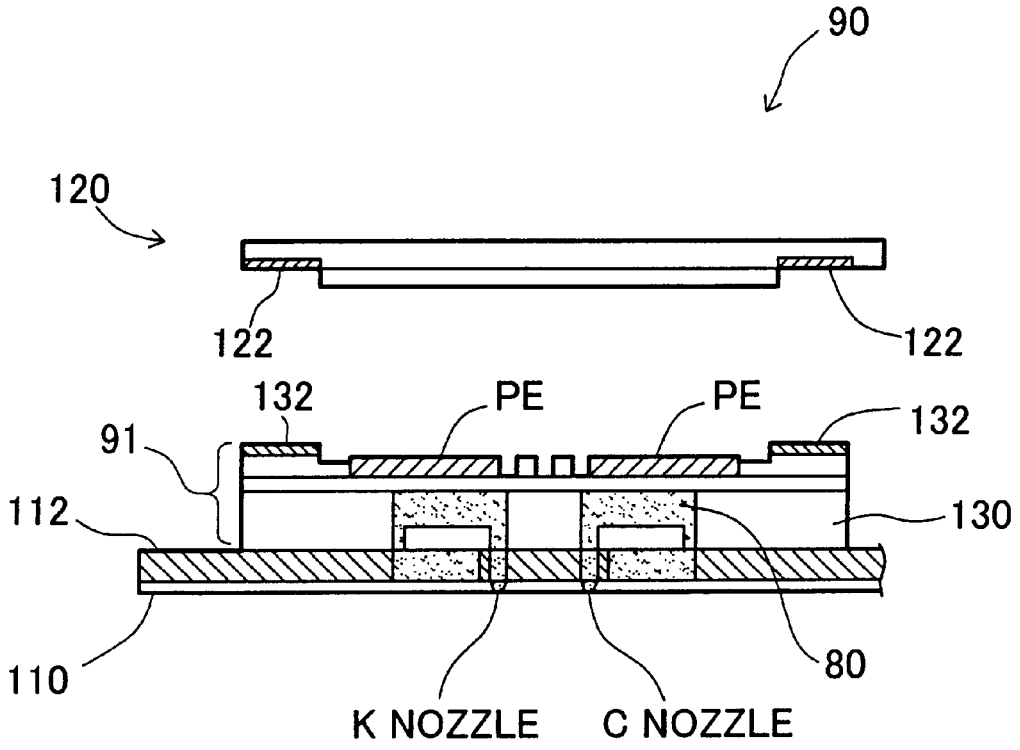
FIG. 8 is a partial cross-sectional view of the actuator circuit 90.

FIG. 8 is a partial cross-sectional view of the actuator circuit 90. This only shows the first actuator chip 91 and the terminal plate 120 in cross-section. However, the other actuator chips 92 and 93 have the same mechanism as that of the first actuator chip 91.

The nozzle plate 110 has nozzle openings for the inks of each color. The reservoir plate 112 is shaped to form a reservoir space to hold the ink. The actuator chip 91 has a ceramic sintered portion 130 that forms the ink passage 80 (FIGS. 5(A) and 5(B)), and on the other side of the upper wall over the ceramic sintered portion 130, piezoelectric elements PE and terminal electrodes 132. When the contact terminal plate 120 is affixed onto the actuator chip 91, electrical contact is formed between the contact terminals 122 on the underside of the contact terminal plate 120 and the terminal electrodes 132 on the upper side of the actuator chip 91. The connecting wiring between the terminal electrodes 132 and the piezoelectric element PE is not shown.

B. Generation of printing positional deviation between nozzle rows:

In the first and second embodiments described below, printing position deviation arising between rows of nozzles during bidirectional printing is adjusted. Before describing the embodiments, an explanation will be given concerning the printing position deviation arising between nozzle rows.

Figure 9:
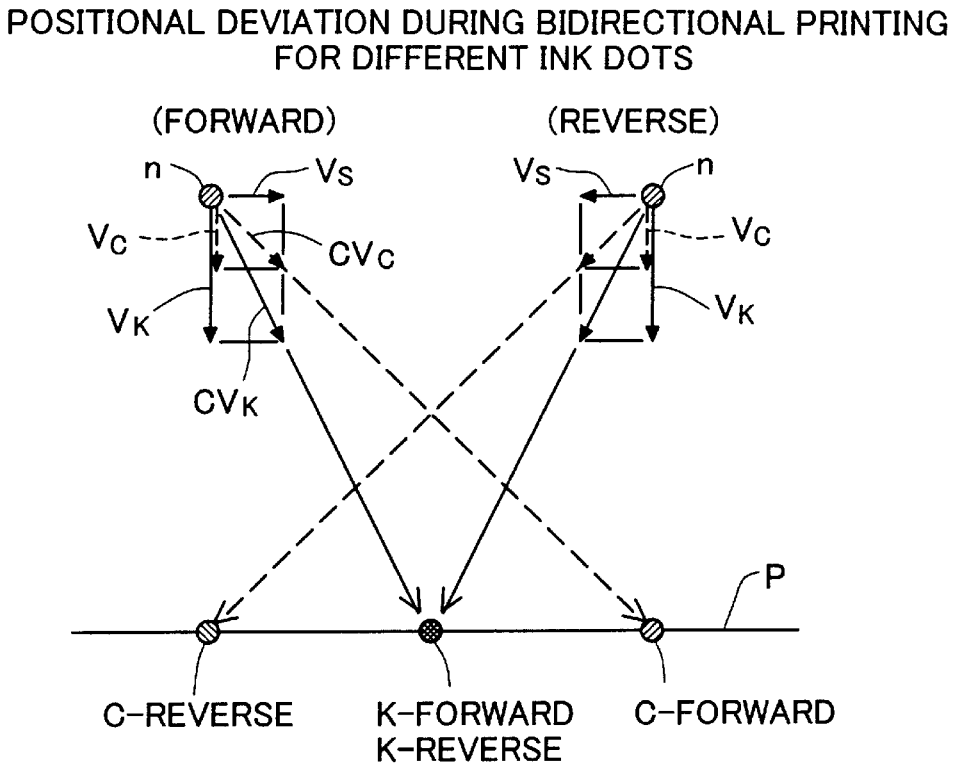
FIG. 9 illustrates positional deviation arising between rows of nozzles during bidirectional printing.

FIG. 9 illustrates positional deviation arising between rows of nozzles during bidirectional printing. Nozzle n is moved horizontally bidirectionally over the paper P with ink being emitted during forward and reverse passes to thereby form dots on the paper P. The drawing shows when black ink K that has been emitted is overlaid with cyan ink C. $V_K$ is the emission velocity of black ink K emitted straight down and $V_C$ is the emission velocity of cyan ink C, which is lower than $V_K$. The composite velocity vectors $CV_K$, $CV_C$ of the inks will be the result of the downward emission velocity vector and the main scanning velocity Vs of the nozzle n. Black ink K and cyan ink C have different downward emission velocities $V_K$ and $V_C$, so the magnitude and direction of the composite velocities $CV_K$ and $CV_C$ also differ.

In this example, black dot positions are adjusted such that positional deviation during bidirectional printing is reduced to zero. However, since the composite velocity vector $CV_C$ of cyan ink C is different from the composite velocity vector $CV_K$ of black ink K, if the same emission timing is used for black ink K and cyan ink C, the result will be major deviation in the position of the printed cyan dots. Also, it can be seen that the relative positional relationship between black dots and cyan dots during a forward pass is reversed during the reverse pass.

Figure 10:
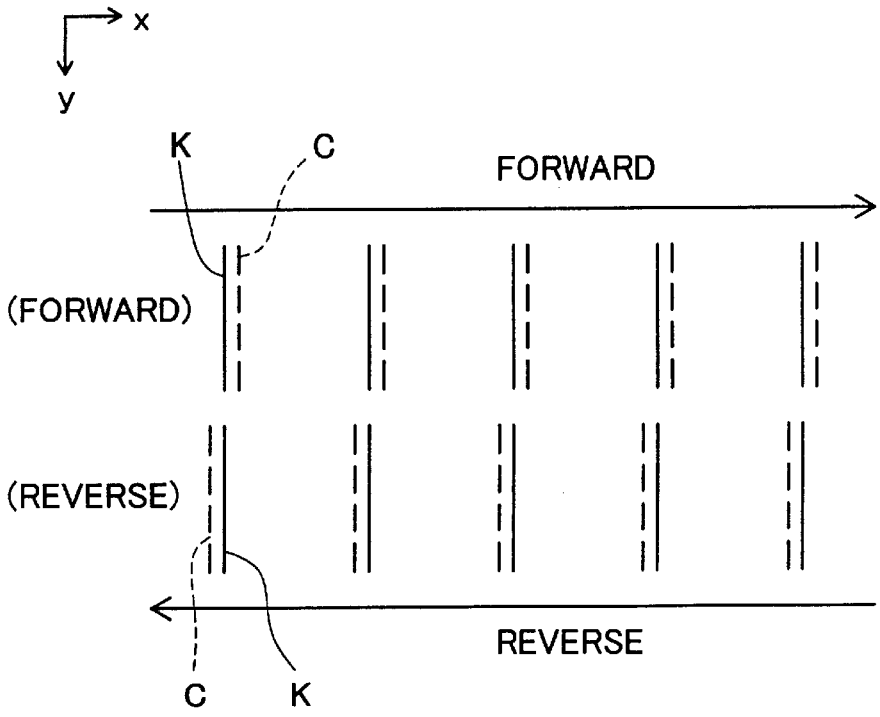
FIG. 10 is a plan view illustrating the printing positional deviation of FIG. 9.

FIG. 10 is a plan view illustrating the printing positional deviation of FIG. 9. The vertical lines in the sub-scanning direction y indicate printing in black ink K and cyan ink C during forward and reverse passes. The vertical lines in black ink K printed during a forward pass are in alignment with the vertical lines printed during the reverse pass at positions in the main scanning direction x. On the other hand, the vertical lines printed in cyan ink on a forward pass are printed to the right of the black ink lines, and on the reverse pass are printed to the left of the black lines.

Thus, when positional deviation is corrected just with respect to printing by the row of black ink nozzles, there have been cases in which, with respect to other rows of nozzles, positional deviation could not be properly corrected.

The velocity of ink droplets emitted from the nozzles depends on the types of factors listed below.

(1) Manufacturing tolerance of the actuator chips.

(2) Physical qualities of the ink (viscosity, for example).

(3) Mass of ink droplets.

When the main factor affecting ink droplet emission velocity is the manufacturing tolerance of the actuator chips, the ink droplets emitted by the same actuator chip are emitted at substantially the same velocity. Therefore, in correcting for positional deviation in the main scanning direction in such a case, it is preferable to effect such correction on a nozzle group by group basis, for each group of nozzles driven by different actuators.

When the physical properties of the ink or the mass of the ink droplets have a major effect on emission velocity, it is preferable to correct for positional deviation of dots printed in the main scanning direction ink by ink or nozzle row by nozzle row.

Figure 11:
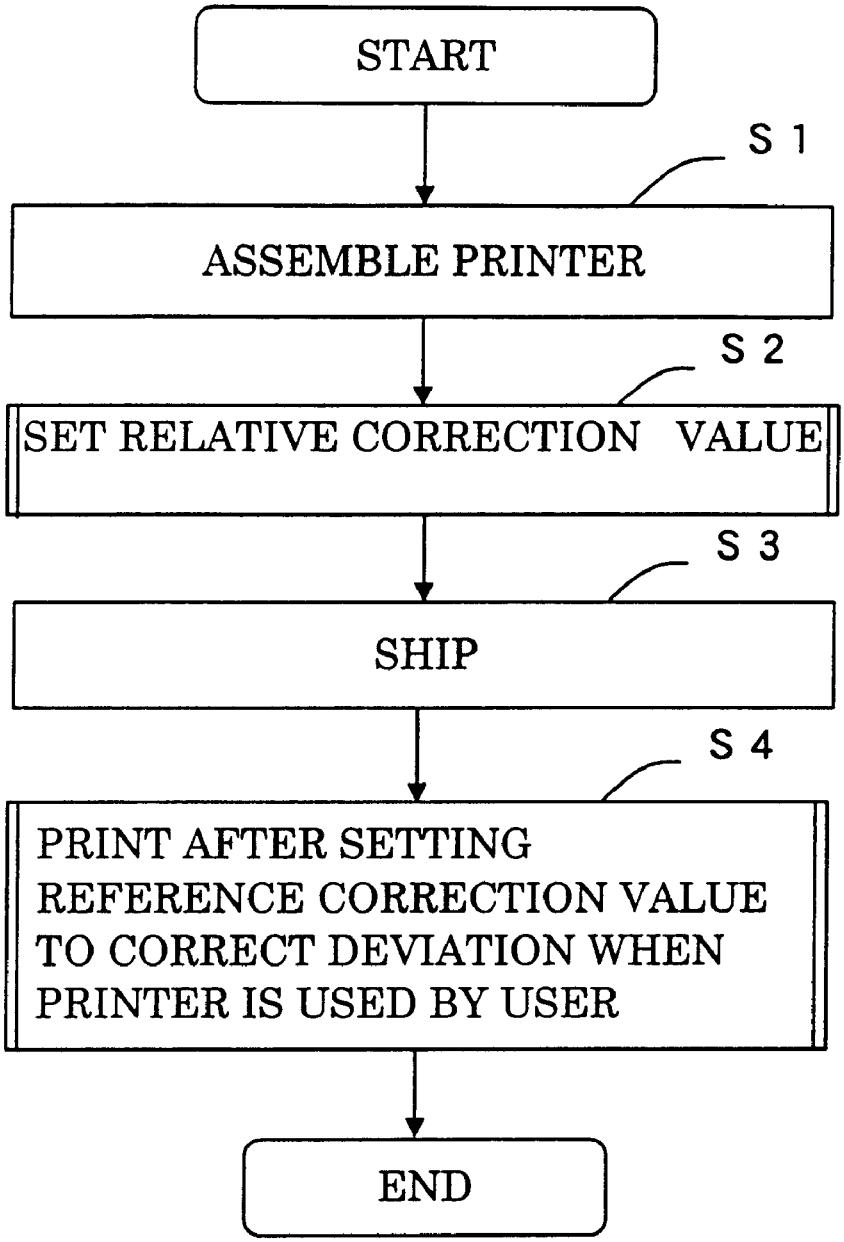
FIG. 11 is a flow chart of the overall processing by the first embodiment.

C. First embodiment (correction of positional deviation between nozzle rows (1)):

FIG. 11 is a flow chart of the process steps in a first embodiment of the invention. In step S1, the printer 20 is assembled on the production line, and in step S2 an operator sets a relative correction value in the printer 20. In step S3 the printer 20 is shipped from the factory, and in step S4, the purchaser of the printer 20 prints after setting a reference correction value for correcting positional deviation during use. Below, steps S2 and S4 are each described in more detail.

Figure 12:
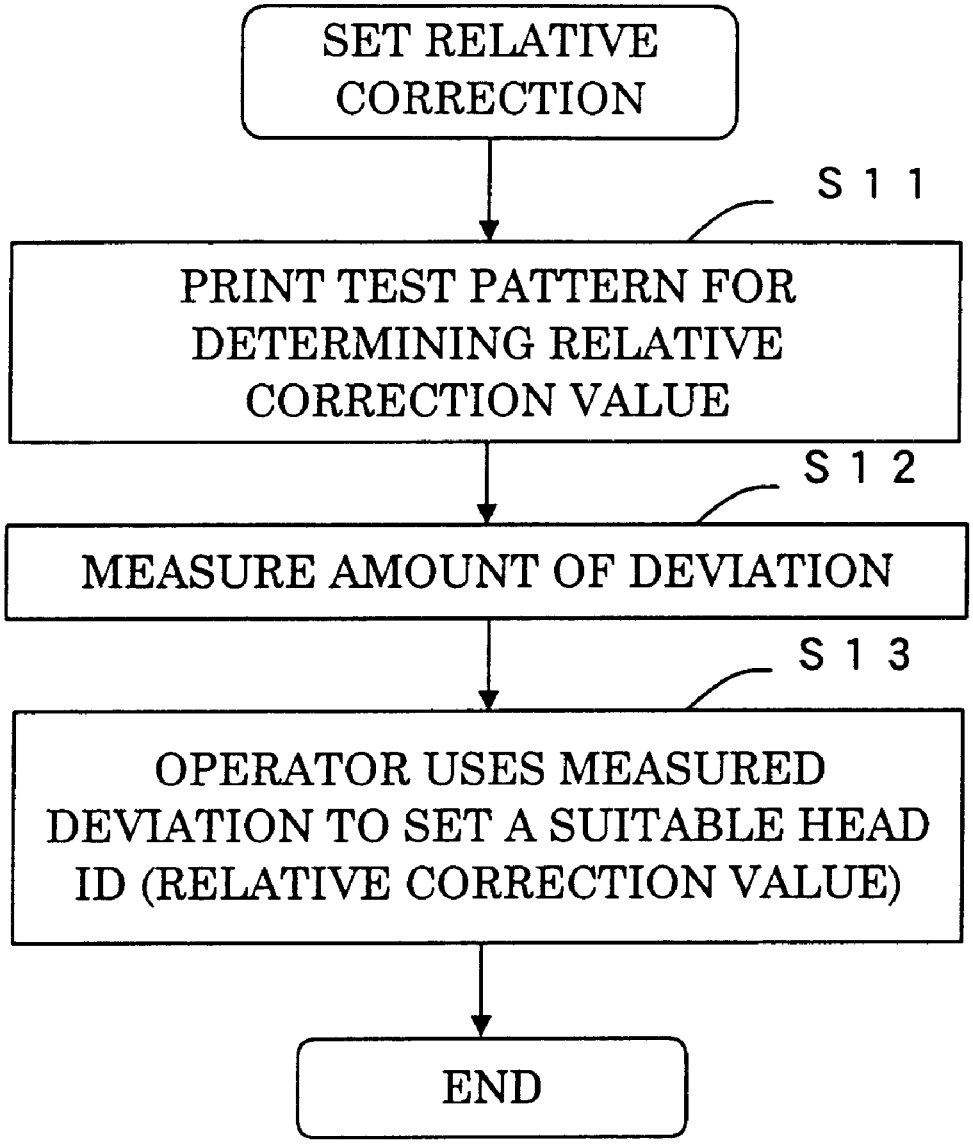
FIG. 12 is a flow chart showing the details of the step S2 procedure of FIG. 11.
Figures 13, 14:
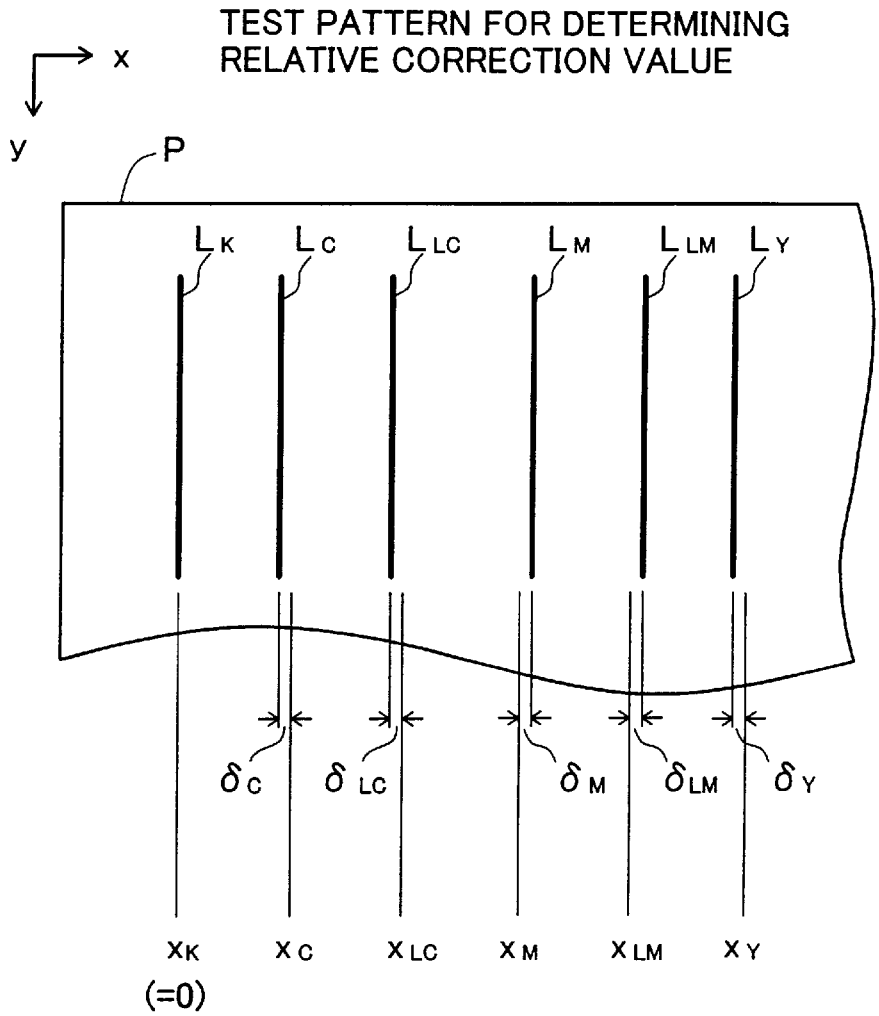
FIG. 13 is an example of a test pattern used to determine relative correction values.
FIG. 14 shows the relationship between relative correction value A and head ID.

FIG. 12 is a flow chart of the detailed procedure of step S2. In step S11, a test pattern is printed to determine the relative correction value. FIG. 13 shows an example of such a test pattern. The test pattern consists of the six vertical lines $L_K$, $L_C$, $L_{LC}$, $L_M$, $L_{LM}$, $L_Y$ formed in the sub-scanning direction y in the six colors K, C, LC, M, LM, Y, respectively. The six lines were printed by ink emitted from the six rows of nozzles simultaneously while moving the carriage 30 at a set speed. In each main scanning pass the dots were formed spaced apart by just the nozzle pitch in the sub-scanning direction, so in order to print the vertical lines as shown in FIG. 13, ink was emitted at the same timing during a plurality of unidirectional main scanning passes.

The test pattern does not have to be composed of vertical lines, but may be any pattern of straight lines of dots printed at intervals. This also applies to test patterns for determining reference correction values described later.

In step S12 of FIG. 12, the amount of deviation between the six vertical lines of FIG. 13 is measured. This can be measured by, for example, using a CCD camera to capture the test pattern and using image processing to measure the positions of the lines $L_K$, $L_C$, $L_{LC}$, $L_M$, $L_{LM}$, $L_Y$ in the main scanning direction x. The six vertical lines are formed simultaneously by the emission of ink from the six rows of nozzles, so if the ink is considered as being emitted at the same velocity from the six sets of nozzles, the spacing of the six lines should be the same as the spacing of the rows of nozzles.

With reference to the x coordinates $X_K$, $X_C$, $X_{LC}$, $X_M$, $X_{LM}$, $X_Y$ shown in FIG. 13, when the x coordinate value $X_K$ of the black ink line $L_K$ is used as a reference the x coordinates of the other five lines $X_C$, $X_{LC}$, $X_M$, $X_{LM}$, $X_Y$ will indicate the coordinates of the lines in accordance with the design pitch of the nozzle rows. Thus, in step S12, with the positions denoted by the x coordinates $X_C$, $X_{LC}$, $X_M$, $X_{LM}$, $X_Y$ being also referred to hereinafter as the design positions, the amount of deviation $\delta_C$, $\delta_{LC}$, $\delta_M$, $\delta_{LM}$, $\delta_Y$ of the five lines relative to the design position is measured. When the deviation is to the right of the design position the deviation amount δ is taken as a plus value, and a minus value when the deviation is to the left of the design position.

In step S13, the measured deviation amount is used as a basis for an operator to determine a suitable head ID and set the head ID in the printer 20. The head ID indicates the suitable relative correction value to use for correcting the measured deviation. A suitable relative correction value Δ is given, for example, by equation (1).

$$\Delta = -\delta ave = -\Sigma \delta i/(N-1) \quad (1)$$

where Σ denotes the arithmetical operation of obtaining the sum of deviations δi of all lines other than the reference black ink line, and N denotes the total number of vertical lines, which is to say, the number of rows of nozzles. The suitable relative correction value Δ is the minus of the average deviation value δave of the lines other than the reference line $L_K$.

FIG. 14 shows the relationship between relative correction value A and head ID. In this example, when the relative correction value Δ is −35.0 μm the head ID is set at 1, and the head ID is incremented by 1 for every 17.5 μm increase in the relative correction value Δ. Here, 17.5 μm is the minimum value by which the printer 20 can be adjusted for deviation in the main scanning direction. As this minimum adjustable value, there may be used a value that is the equivalent of the dot pitch in the main scanning direction. With respect to a printing resolution of 1440 dots per inch (dpi) in the main scanning direction, for example, the dot pitch is approximately 17.5 μm (=25.4 cm/1440), so that can be used as the minimum adjustable value. It is also possible to use a minimum adjustable value that is smaller than the dot pitch.

The head ID thus determined is stored in the PROM 43 (FIG. 2) in the printer 20. In this embodiment, a seal 100 showing the head ID is also provided on the top of the print head unit 60 (FIG. 3). It is also possible to provide the driver IC 126 in the print head unit 60 with a non-volatile memory, such as a PROM, and store the head ID in the non-volatile memory. The advantage of either method is that when the print head unit 60 is used in another printer 20, it enables the right head ID for that print head unit 60 to be used.

The determination of the relative correction value of step S2 can be carried out in the assembly step prior to when the print head unit 60 is installed in the printer 20, using the print head unit 60 installed in a special inspection apparatus. In this case, the head ID can be stored in the PROM 43 during the subsequent installation of the print head unit 60 in the printer 20. The head ID can be stored in the PROM 43 by using a special reader to read the head ID seal 100 or an operator can use a keyboard to manually key in the head ID. Alternatively, the head ID stored in non-volatile memory in the print head unit 60 can be transferred to the PROM 43.

The average of the light cyan and light magenta deviation amounts may be used as the relative correction value A, as given by equation (2).

$$\Delta=-(\delta_{LC}+\delta_{LM})/2 \quad (2)$$

Light cyan and light magenta are the inks used most extensively in middle tone regions of color images (especially in the density range of approximately 10 to 30% for cyan and magenta), and the positional precision of dots printed in these colors has a major effect on the image quality. Thus, using the average deviation of dots printed in light cyan and light magenta to determine the head ID makes it possible to decrease the positional deviation, thereby improving the quality of the color images.

When using equation (2), it is enough just to measure the deviations $\delta_{LC}$, $\delta_{LM}$ for light cyan and light magenta from the black ink dots.

As shown in the flow chart of FIG. 11, the printer 20 is shipped after the head ID has been set in the printer 20. When the printer 20 is to be used, the user uses the head ID to adjust as follows for positional deviation during bidirectional printing.

Figure 15:
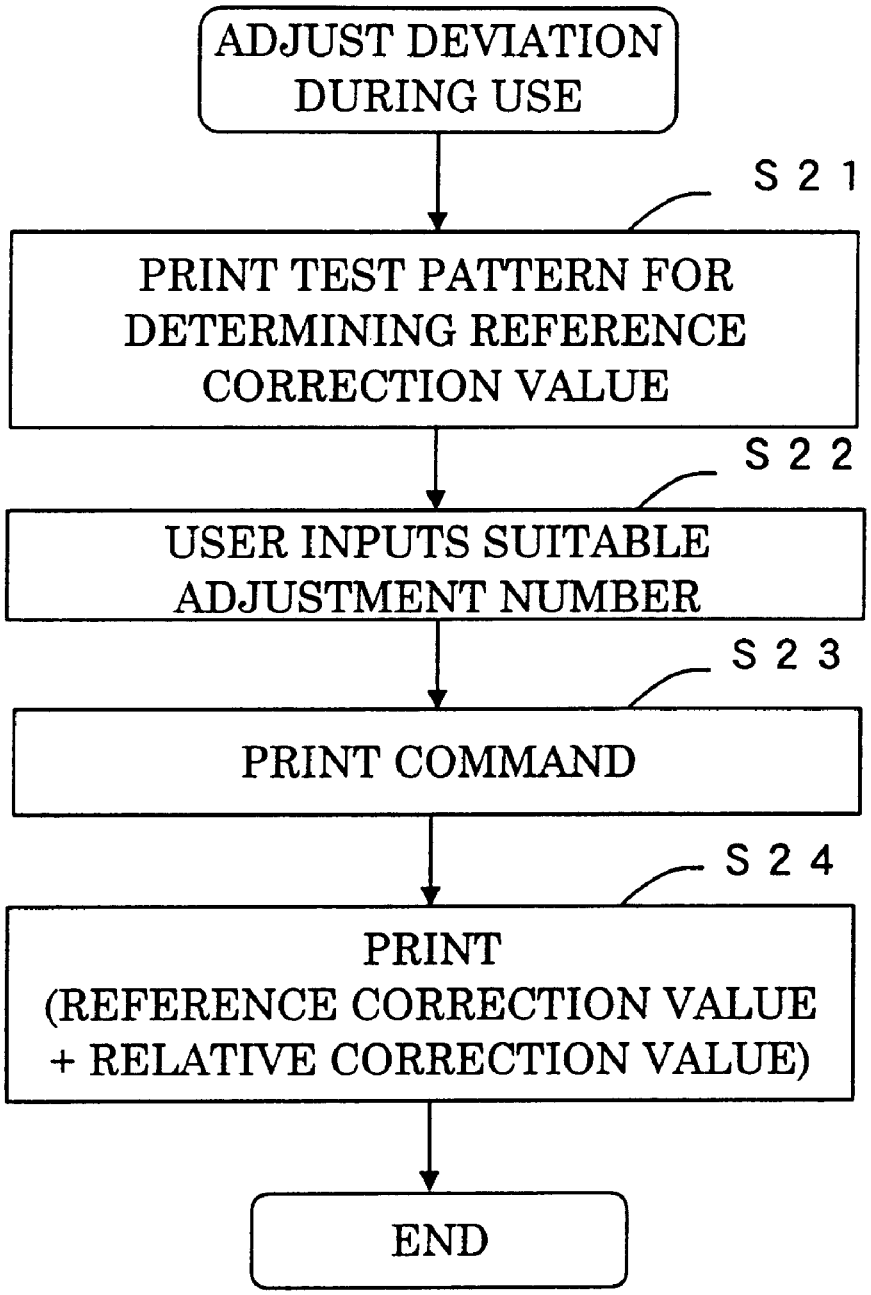
FIG. 15 is a flow chart showing the details of the step S4 procedure of FIG. 11.
Figure 16:
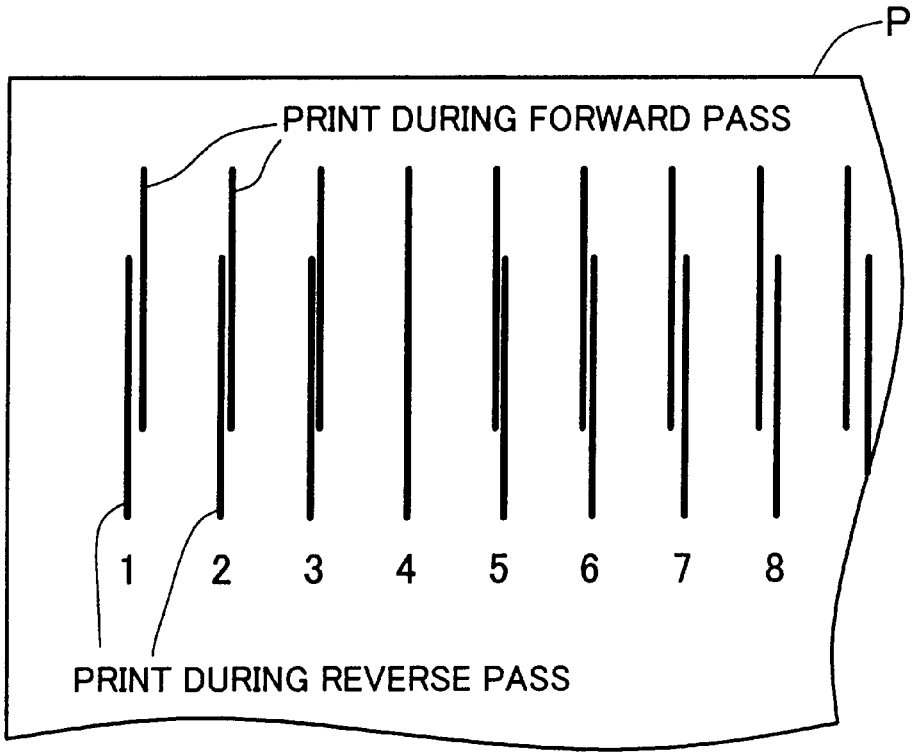
FIG. 16 is an example of a test pattern used to determine reference correction values.

FIG. 15 is a flow chart of the deviation adjustment procedure carried out by the user. In step S21 the printer 20 is used to print out a test pattern to determine the reference correction value. FIG. 16 shows an example of such a test pattern. The test pattern consists of a number of vertical line pairs printed in black ink during forward and reverse passes. The lines printed during the forward pass are evenly spaced, but on the reverse pass the position of the lines is sequentially displaced along the main scanning direction in units of one dot pitch. As a result, multiple pairs of vertical lines are printed in which the positional deviation between line pairs printed during the forward and reverse passes is changed by one dot pitch at a time. The numbers printed below the pairs of lines are deviation adjustment numbers denoting correction information required to achieve a preferred corrected state. A preferred corrected state refers to a state in which, when the printing position (and printing timing) during forward and reverse passes has been corrected using an appropriate reference correction value, the positions of dots formed during forward passes in the main scanning direction coincide with the positions of dots formed during reverse passes in the main scanning direction. Thus, the preferred corrected state is achieved by the use of an appropriate reference correction value. In the example of FIG. 16, the line pairs with the deviation adjustment number 4 are in a preferred corrected state.

The test pattern for determining the reference correction value is formed by the reference row of nozzles which is used for determining the relative correction value. Therefore, when the row of magenta ink nozzles is used as the reference nozzle row, in place of the row of black ink nozzles, in determining the relative correction value, the test pattern for determining the reference correction value is also formed using the row of magenta ink nozzles.

The user inspects the test pattern and uses a printer driver input interface screen (not shown) on the computer 88 to input the deviation adjustment number of the vertical line pairs having the least deviation. The deviation adjustment number is stored in the PROM 43.

Figure 17:
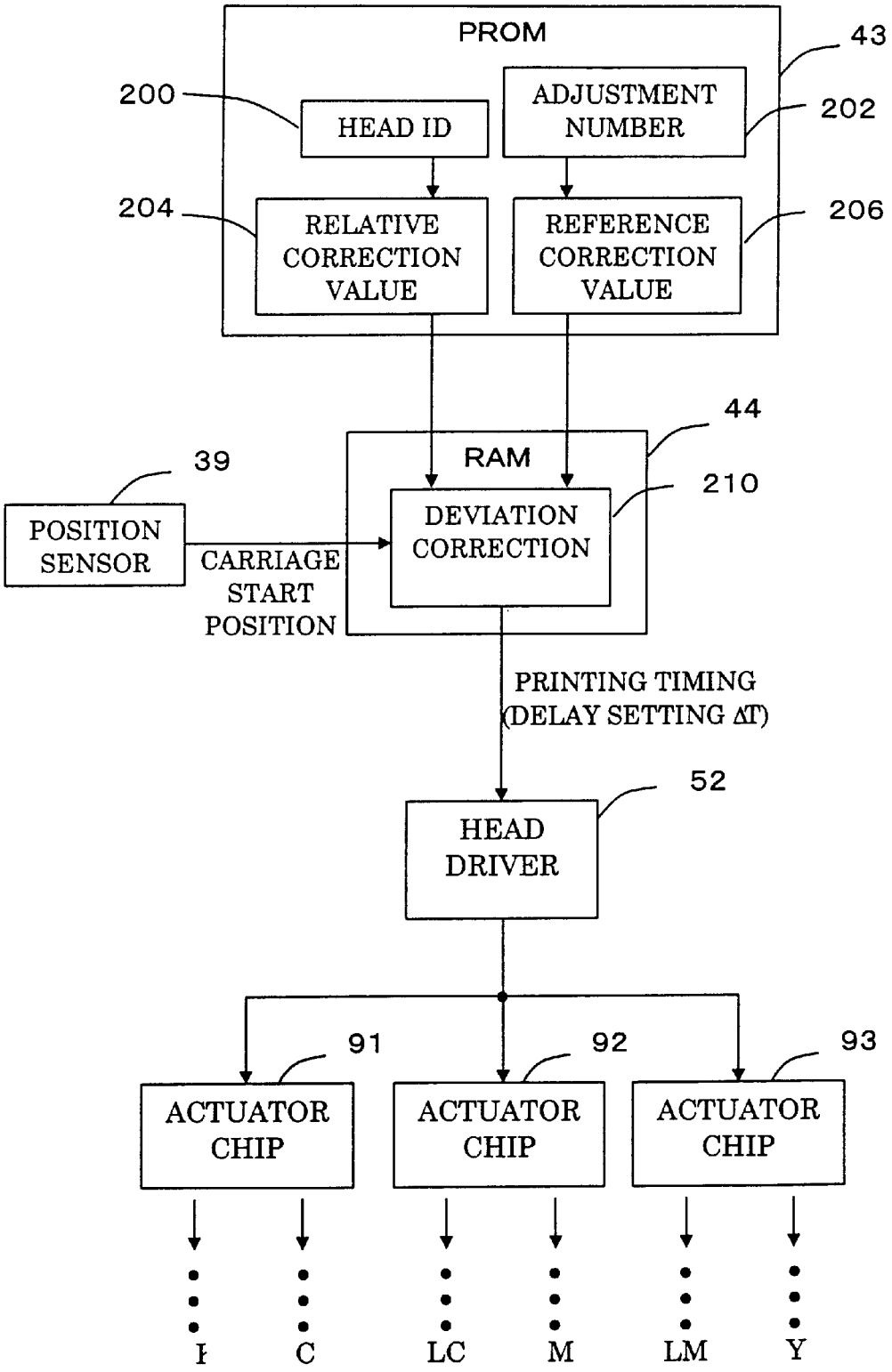
FIG. 17 is a block diagram of the main configuration involved in the correction of deviation arising during bidirectional printing in the case of the first embodiment.

Next, in step S23, the user issues the command to start the printing, and in step S24, bidirectional printing is carried out while using the reference and relative adjustment values to correct deviation. FIG. 17 is a block diagram of the main configuration involved in the correction of deviation during bidirectional printing in the case of the first embodiment.

The PROM 43 in the printer 20 has a head ID storage area 200, an adjustment number storage area 202, a relative correction value table 204 and a reference correction value table 206. A head ID indicating the preferred relative correction value is stored in the head ID storage area 200, 10 and a deviation adjustment number indicating the preferred reference correction value is stored in the adjustment number storage area 202. The relative correction value table 204 is one such as that shown in FIG. 14, which shows the relationship between head ID and relative correction value Δ. The reference correction value table 206 is a table showing the relationship between deviation adjustment number and reference correction value.

The RAM 44 is used to store a computer program that functions as a positional deviation correction section (or adjustment value determination section) 210 for correcting positional deviation during bidirectional printing. The deviation correction section 210 reads out from the relative correction value table 204 a relative correction value corresponding to the head ID stored in the PROM 43, and also reads out from the reference correction value table 206 a reference correction value corresponding to the deviation adjustment number. During a reverse pass, when the deviation correction section 210 receives from the position sensor 39 a signal indicating the starting position of the carriage 30, it supplies the head drive circuit 52 with a printing timing signal, indicating a delay setting ΔT, that corresponds to a correction value that is a composite of the relative and reference correction values. The three actuator chips 91 to 93 in the head drive circuit 52 are supplied with identical drive signals, whereby the positioning of dots printed during the reverse pass is adjusted in accordance with the timing supplied from the deviation correction section 210 (that is, by a delay setting ΔT). As a result, on the reverse pass, the printing positions of the six rows of nozzles are all adjusted by the same correction amount. As already described in the foregoing, relative and reference correction amounts are both set at values that are integer multiples of the dot pitch in the main scanning direction, so the printing position (meaning the printing timing) also is adjusted in dot pitch units in the main scanning direction. The composite correction value is obtained by adding the reference and relative correction values.

FIGS. 18(A)–18(D) illustrate the correction of positional deviation using reference and relative correction values. FIG. 18(A) shows deviation between vertical lines formed of dots printed in black ink during forward and reverse passes without the use of adjustment to correct the positional deviation. FIG. 18(B) shows the result of using a reference correction value to correct the positional deviation of the black lines. Thus, correction using the reference correction value eliminated positional displacement of the black-dot lines during bidirectional printing. FIG. 18(C) shows the result of lines printed in cyan as well as black, using the same adjustment as in FIG. 18(B). As in FIG. 10, there is no deviation of the black lines, but there is quite a lot of deviation of the cyan lines. FIG. 18(D) shows black lines and cyan lines printed after correction based on both of a reference correction value and a relative correction value $\Delta(=\delta_C)$ to the cyan dots. This reduces deviation of the cyan dots, and slightly increases the deviation of the black dots. The overall result is therefore that positional deviation of both black dots and cyan dots is decreased by roughly the same amount. In the example of 18(D), black dots and cyan dots are selected as the target dots for positional correction, and correction of positional deviation is applied to those two types of dots.

FIGS. 19(A)–19(D) illustrate correction of positional deviation applied to cyan dots only. The reference adjustment values used in FIG. 19(A) to FIG. 19(C) are the same as those applied in FIG. 18(A)–18(C), while the value used in FIG. 19(D) differs from that used in FIG. 18(D). In the case of FIG. 19(D), as the relative correction value Δ there is used a value comprising twice the deviation amount $\delta_C$ of the cyan dots of the test pattern for determining the relative correction value (FIG. 13) (more accurately, a value given a minus sign). While this increases the deviation of the black dots, it enables positional deviation between cyan dots formed during the forward pass and cyan dots formed during the reverse pass to be reduced virtually to zero.

As can be understood from the examples shown in FIGS. 18(A)–18(D) and FIGS. 19(A)–19(D), when the deviation amount δ of specific dots in the test pattern for determining relative correction values is itself used as the relative correction value Δ, both the specific dots and the reference dots (black dots) form the target dots for correction of positional deviation, thereby making it possible to reduce positional deviation of these target dots. When twice the deviation amount $\delta_C$ of specific dots of the test pattern for determining the relative correction value is used as the relative correction value Δ, only the specific dots are targeted for correction of positional deviation, making it possible to reduce the positional deviation of those target dots. Specifically, using the relative correction value Δ derived from equation (2) $(=-(\delta_{LC}+\delta_{LM})/2)$ makes it possible to reduce positional deviation by more or less the same amount in respect of three types of dots, black, light cyan and light magenta. Moreover, when the double value is used as the relative correction value, it is possible to reduce positional deviation by more or less the same amount in respect of two types of dots, light cyan and light magenta. Similarly, when the relative correction value Δ (=−δave) of equation (2) is used, it becomes possible to reduce positional deviation by more or less the same amount in respect of all six types of dots. Also, when the double value is used as the relative correction value, it is possible to reduce positional deviation by more or less the same amount in respect of all types of dots other than the black dots.

As revealed by FIG. 18(D) and FIG. 19(D), adjusting positional deviation based on the reference and relative correction values improves the quality of the color images by preventing the positional deviation of the dots of colored inks from becoming excessively large.

In monochrome printing colored inks are not used, so there is no need for the type of positional adjustment correction using relative correction values as in FIG. 18(D) and FIG. 19(D). Thus, in the case of monochrome printing it is preferable to apply deviation correction using just a reference correction value, as in FIG. 18(B). Thus, it is preferable to use a configuration whereby when the computer 88 instructs the printer control circuit 40 (specifically, the deviation correction section 210 shown in FIG. 17) to print in monochrome, just a reference correction value is used to correct positional deviation during bidirectional printing, and when the instruction is to print in color, both a reference correction value and a relative correction value are used to correct positional deviation during bidirectional printing.

When it becomes necessary, for whatever reason, to replace the print head unit 60, the head ID of the new print head unit 60 is written into the PROM 43 in the control circuit 40 of the printer 20. This can be done in a number of ways. One way is for the user to use the computer 88 to input the head ID displayed on the head ID seal 100 attached to the print head unit 60 to the PROM 43. Another method is to retrieve the head ID from the non-volatile memory of the driver IC 126 (FIG. 7) and write it into the PROM 43. Thus storing in the PROM 43 the head ID of the new print head unit 60 ensures that positional deviation during bidirectional printing will be corrected using the proper head ID (that is, the proper relative correction value) for that print head unit 60.

As described in the foregoing, in accordance with this first embodiment a relative correction value is set for correcting positional deviation arising during bidirectional printing with respect to the rows of non-black nozzles while using the row of black ink nozzles as the reference for adjustment. Thus, this relative correction value and the reference correction value for the row of black ink nozzles are used to correct positional deviation during bidirectional printing, thereby making it possible to improve the quality of the printed color images. An advantage is that a user does not have to make adjustments to correct positional deviation in respect of all inks, but only has to adjust for positional deviation in respect of the reference row of nozzles to achieve improved image quality during bidirectional printing of color images. In the case of monochrome printing, it is only necessary to use a reference correction value to correct for positional deviation during bidirectional printing, which is advantageous in that there is no degradation in the monochrome printing.

Figure 20:
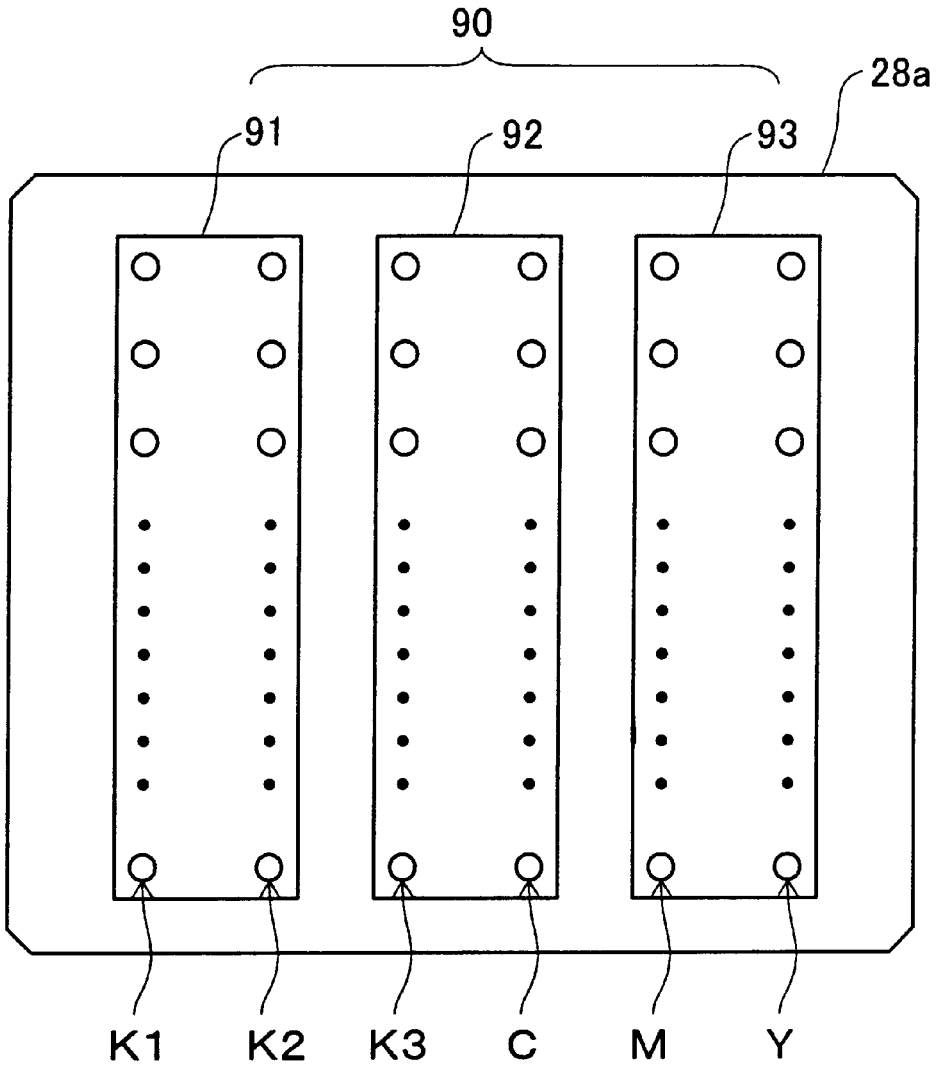
FIG. 20 illustrates the configuration of a different print head 28*a*.

FIG. 20 illustrates a different configuration of print head nozzles. In this example, print head 28*a* is provided with three rows of black (K) ink nozzles K1 to K3, and one row each of cyan (C), magenta (M) and yellow (Y) ink nozzles. During monochrome printing, the three rows of black ink nozzles can all be used, enabling high-speed printing. During color printing, the two rows of black ink nozzles K1 and K2 of the actuator chip 91 are not used, with printing being performed using the row of black ink nozzles K3 of actuator chip 92, together with the rows of cyan, magenta and yellow ink nozzles C, M and Y.

When printing in color using this head, the average of the cyan and magenta deviation amounts, or a value that is twice that value, as given by equations (3a) and (3b), is applied as the relative correction value Δ used during bidirectional color printing.

$$\Delta=-(\delta_C+\delta_M)/2 \quad (3a)$$

$$\Delta=-(\delta_C+\delta_M) \quad (3b)$$

The cyan and magenta deviation amounts $\Delta_C$ and $\delta_M$ are relative deviation amounts measured in the test pattern (FIG. 13) for determining the relative correction value while using the row of black ink nozzles K3 as the reference.

When performing this four-color printing without light inks, it is possible to improve the quality of the color images by using the average of the cyan and magenta deviation amounts to determine a head ID. The reason that yellow is disregarded is that yellow dots are not very noticeable, so that even if there is some deviation of yellow dots during bidirectional printing, this does not have any major effect on the image quality. However, the head ID may be determined based on the average of the cyan, magenta and yellow deviation amounts. That is to say, a relative correction value may be determined that is based on the average of the deviation amounts of all the rows of nozzles other than the reference row.

The relative correction value ΔK of black ink nozzle rows K1 and K2 with respect to the reference black ink nozzle row K3 may be obtained, in accordance with equation (4).

$$\Delta K=-(\delta_{K1}+\delta_{K2})/2 \quad (4)$$

where, $\delta_{K1}$ is the deviation amount relative to row K1 and δK2 is the deviation amount relative to row K2.

Positional deviation arising during bidirectional monochrome printing using the three rows of black ink nozzles can be decreased by correcting deviation during bidirectional printing using relative correction value Δ in respect of rows K1 and K2 and the reference correction value in respect of the reference row K3 (determined in FIG. 15). That is, when printing in monochrome using multiple rows of black ink nozzles, it is desirable to correct positional deviation during bidirectional printing by using a reference correction value in respect of a specified reference row of black ink nozzles, and a relative correction value in respect of the other rows of black ink nozzles.

Figure 21:
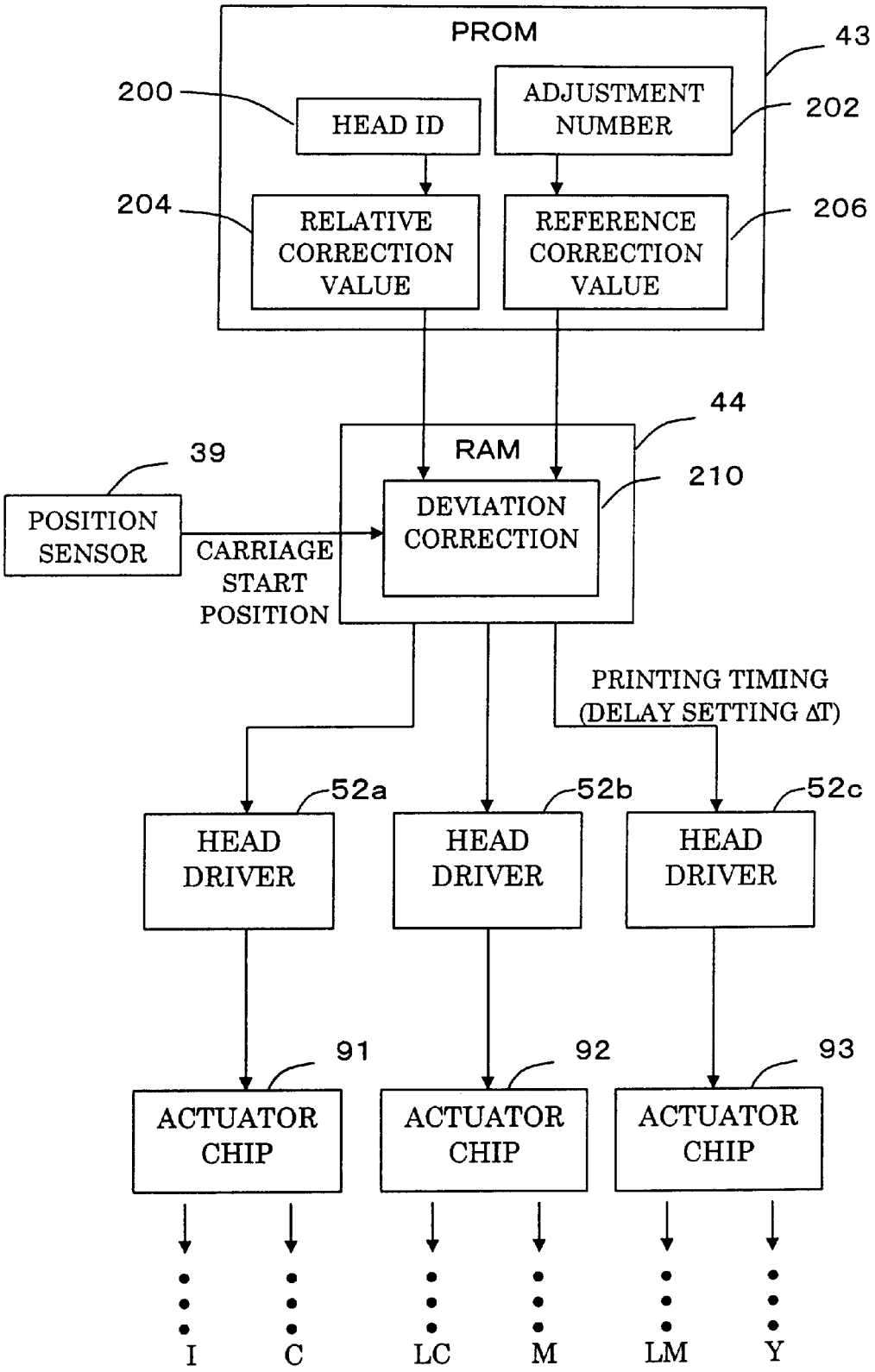
FIG. 21 is a block diagram of the control circuit 40*a* used in a second embodiment.

D. Second embodiment (correction of positional deviation between nozzle rows (2)):

FIG. 21 is a block diagram of the main configuration involved in the correction of deviation during bidirectional printing in the second embodiment. The difference compared to the configuration of FIG. 17 is that each of the actuator chips 91, 92 and 93 is provided with its own, independent head drive circuit 52*a*, 52*b* and 52*c*. Thus, printing timing signals from the deviation correction section 210 can be independently applied to the head drive circuits 52*a*, 52*b* and 52*c*. Therefore, correction of positional deviation during bidirectional printing can also be effected on an actuator chip by chip basis.

In this second embodiment, too, the row K of black ink nozzles of the first actuator chip 91 is used as the reference. Thus, as in the first embodiment, the reference correction value is determined using a test pattern printed using the row K of black ink nozzles.

In this second embodiment a relative correction value is determined for each actuator chip. That is, as the relative correction value $\Delta_{91}$ for the first actuator chip 91, there can be used a value that is the minus of the deviation amount $\delta_C$ of the vertical lines printed using the row C of dark cyan nozzles, as per equation (4a).

$$\Delta_{91}=-\delta_C \quad (4a)$$

Also, as the relative correction values $\Delta_{92}$, $\Delta_{93}$ for the second and third actuator chips 92 and 93, there can be used values that are each the minus of the average deviation of the nozzle rows of each actuator chip, as per the following equations (4b) and (4c).

$$\Delta_{92}=-(\delta_{LC}+\delta_M)/2 \quad (4b)$$

$$\Delta_{93}=-(\delta_{LM}+\delta_Y)/2 \quad (4b)$$

Also, the relative correction values $\Delta_{92}$ and $\Delta_{93}$ for the second and third actuator chips 92 and 93 may be determined from the amount of printing position deviation with respect to one nozzle row from the reference nozzle row. In such a case, equations (5b) and (5c) can be used in place of equations (4b) and (4c).

$$\Delta_{92}=-\delta_{LC} \quad (5b)$$

$$\Delta_{92}=-\delta_{LM} \quad (5c)$$

A head ID representing the three relative correction values $\Delta_{91}$, $\Delta_{92}$ and $\Delta_{93}$ is stored in the PROM 43 of the printer 20. The deviation correction section 210 is supplied with the relative correction values $\Delta_{91}$, $\Delta_{92}$ and $\Delta_{93}$ corresponding to this head ID. Instead of equations (4a)–(4c), (5b) and (5c), a value that is twice the value of the right-side term of the equations can be used as the relative correction value.

The second embodiment described above is characterized in that a relative correction value can be independently set for each actuator chip. This makes it possible to correct the relative positional deviation from the row of reference nozzles on an actuator chip by chip basis, enabling the positional deviation during bidirectional printing to be further decreased. Also, in the type of printer in which each actuator chip is used to drive three rows of nozzles, a relative correction value can be set independently for each three rows of nozzles.

From the viewpoint of improving the image quality of middle tone regions, it is preferable to select light cyan dots and light magenta dots as the target dots for positional deviation adjustment to reduce the positional deviation of those dots. When color printing is performed using M types of ink (where M is an integer of two or more), of the dots of M types of ink, dots of specific inks having a relatively low density (which is to say, inks other than black) can be selected as the target dots and the working principle of the first and second embodiments can be applied to reduce the positional deviation of those target dots.

E. Third embodiment (correction of positional deviation between dots of different sizes (1)):

In the first and second embodiments described in the foregoing, printing positional deviation between rows of nozzles was corrected. In the third to fifth embodiments described below, printing positional deviation between dots of different sizes is corrected.

Figure 22A:
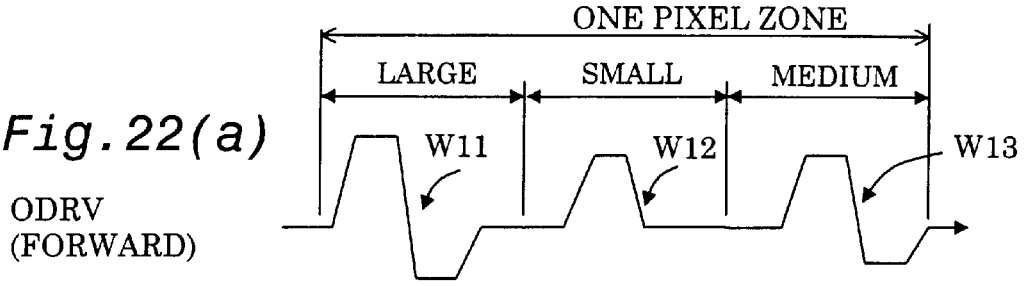
FIGS. 22(*a*) and 22(*b*) show the waveforms of a base drive signal ODRV used in a third embodiment.
Figure 22B:
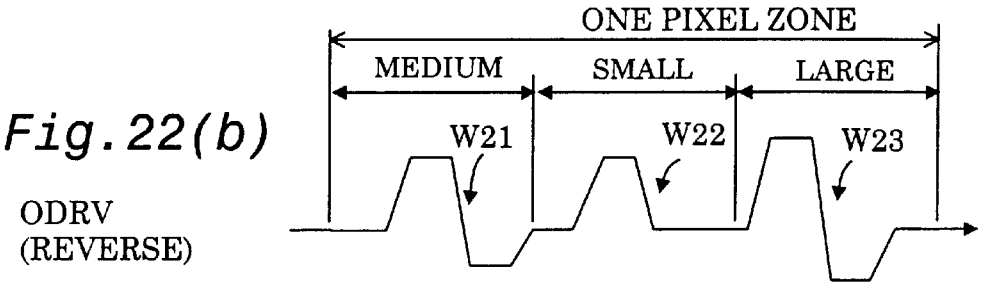

FIGS. 22(*a*) and 22(*b*) illustrate the waveform of a base drive signal ODRV that in this third embodiment is supplied from the head drive circuit 52 (FIG. 2) to the print head 28. During a forward pass, in a single pixel zone, the base drive signal ODRV generates a large dot waveform W11, a small dot waveform W12 and a medium dot waveform W13, in that order. And during a reverse pass, in a single pixel zone, a medium dot waveform W21, a small dot waveform W22 and a large dot waveform W23 are generated, in that order. During a forward pass or a reverse pass, any one of the three waveforms can be selectively used to print a large, small or medium dot at a pixel position.

Figure 23:
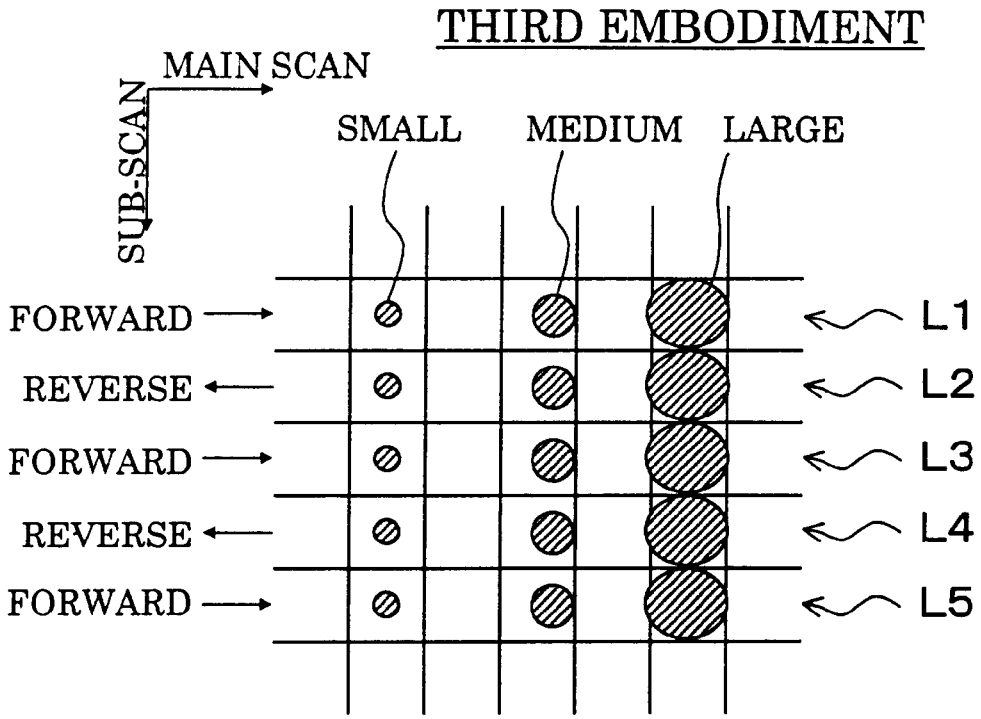
FIG. 23 shows the three types of dots formed using the third embodiment.

The order of the large, medium and small dot waveforms during the forward pass is set different from that during the reverse pass in order to substantially match the respective dot positions in the main scanning direction during the forward and reverse passes. FIG. 23 shows the three types of dots formed using the base drive signal ODRV shown in FIGS. 22(*a*) and 22(*b*). The grid of FIG. 23 shows the boundary of a pixel zone, with each of the squares into which the grid is divided corresponding to the region of a single pixel. The dot in each pixel region is printed by ink droplets emitted by the print head 28 as the print head 28 is moved in the main scanning direction. In the example of FIG. 23, odd numbered raster lines L1, L3, L5 are printed on a forward pass and even numbered raster lines L2, L4 are printed on a reverse pass. By adjusting the amount of ink emitted on a pixel by pixel basis, at each pixel position it is possible to form dots of any of the three different sizes.

Small dots formed in either a forward pass or a reverse pass are located more or less in the center of a pixel region. Medium dots are formed on the right-hand side of a pixel region, while large dots take up substantially the whole of a pixel region. Using the base drive signal ODRV shown in FIGS. 22(*a*) and 22(*b*) makes it possible to obtain a substantial match between the point of impact of ink droplets emitted during a forward pass and the point of impact of ink droplets emitted during the reverse pass. In practice, of course, some positional deviation will arise between dots printed bidirectionally, which is why it is necessary to make positional adjustments.

Figure 24:
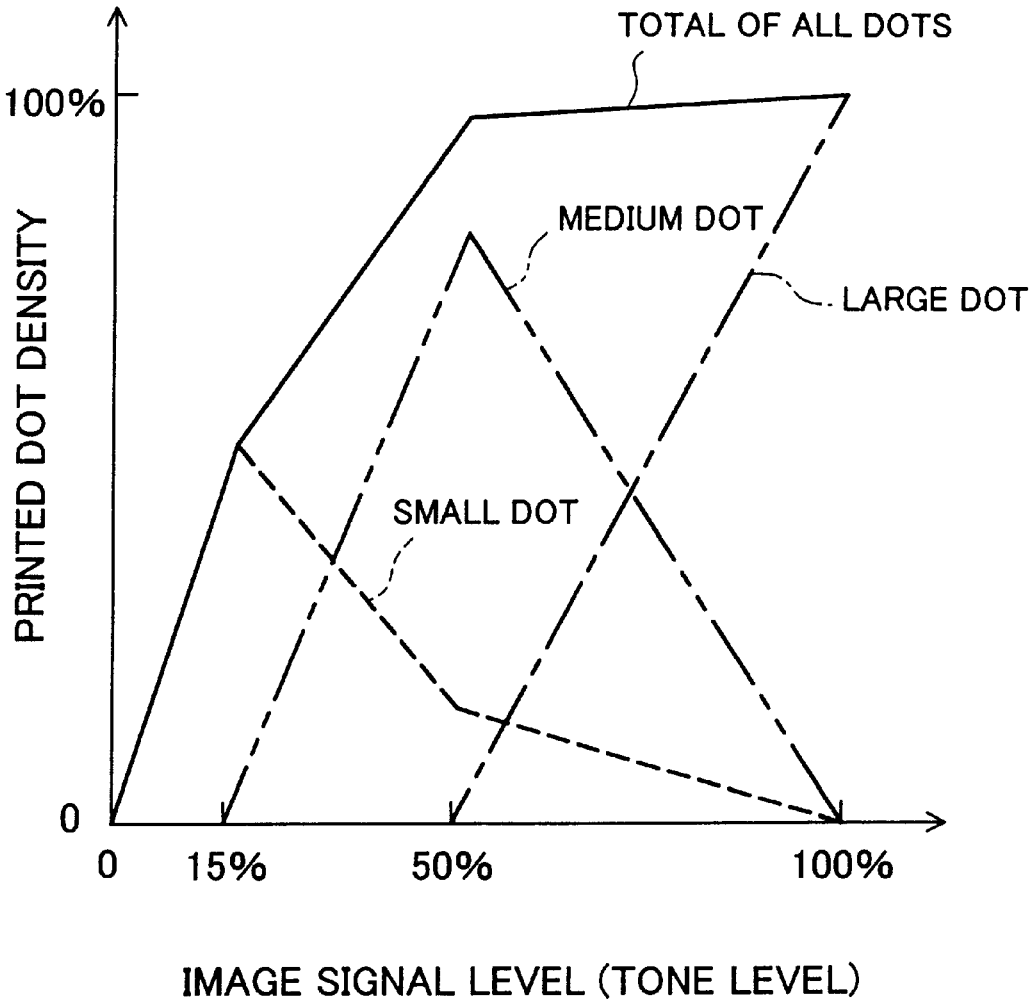
FIG. 24 is a graph showing tone reproduction using the three types of dots.

FIG. 24 is a graph illustrating tone reproduction using the three types of dots. In FIG. 24 the horizontal axis is the relative image signal level and the vertical axis is the printed dot density. Here, printed dot density refers to the proportion of the pixel positions in which dots are formed. For example, in a region containing 100 pixels in which dots are formed at 40 pixel positions, the printed dot density is 40%. The image signal level corresponds to a tone value indicating image density level.

In the graph of FIG. 24, in a tone range in which the image signal level is from 0% to 16%, the printed dot density of small dots increases linearly from 0% to around 50% with the increase in image signal level. As a result, at an image portion in which the image signal level is about 16%, small dots are formed at about half the dot positions. In a tone range in which the image signal level is from about 16% to about 50%, the printed dot density of small dots decreases linearly from about 50% to about 15% with the decrease in image signal level, while the printed dot density of medium dots increases linearly from 0% to about 80%. In a tone range in which the image signal level is from about 50% to 100%, the printed dot density of small and medium dots decreases linearly down to 0% with the increase in image signal level, while the printed dot density of large dots increases linearly from 0% to 100%. Thus, by using one or two types of dots to print each portion of the image in accordance with the image signal level of that image portion, it is possible smoothly to linearly reproduce the density levels of an image.

Deviation between printing positions on a forward pass and printing positions on the reverse pass are readily noticeable in the region where the tone range is up to about 50% (about 10% to about 50%). Deviation between the printing positions on a forward pass and the printing positions on the reverse pass in the case of medium and small dots, which are used extensively in middle tone regions, tends to be readily noticeable in images in middle tone regions.

A problem that arises when a test pattern for adjusting positional deviation arising in bidirectional printing is printed using medium or small dots is that a user finds it difficult to perceive positional deviation in the test pattern. Therefore, a test pattern that is to be used for adjustment by a user should be printed using large dots. In the third embodiment, taking all this into consideration, when a user is to be making the adjustments, the reference correction value for correcting positional deviation is set using a test pattern printed using large dots. Moreover, correcting this reference correction value using a relative correction value determined in advance makes it possible to effect adjustment during printing that reduces printing positional deviation of small and medium dots.

The process sequence used in the third embodiment is the same as that used in the first embodiment described with reference to FIGS. 11, 12 and 15. However, the test pattern used to determine relative correction values differs from that used in the first embodiment.

Figure 25:
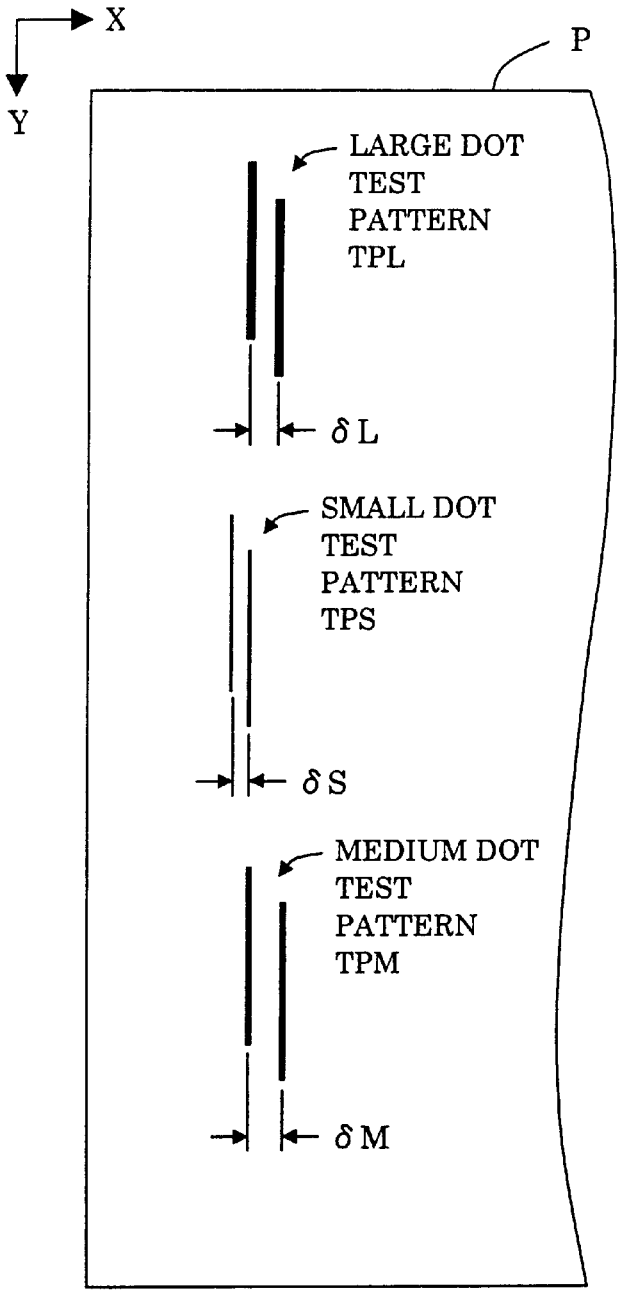
FIG. 25 shows an example of a test pattern used for determining relative correction values in the third embodiment.

FIG. 25 shows an example of a test pattern used for determining relative correction values. The test pattern printed on paper P includes a test pattern TPL for large dots, a test pattern TPS for small dots and a test pattern TPM for medium dots. The three test patterns TPL, TPS and TPM each comprise a pair of vertical lines formed in black ink in forward and reverse passes by the printer. To facilitate accurate measurement of the lines, it is desirable to form the lines as straight lines one dot in width.

In the third embodiment, the deviation measurement of step S12 (FIG. 12) is carried out by measuring the amount of deviation δL, δS and δM between the lines of the test patterns TPL, TPS and TPM of FIG. 25 printed on a forward pass and the lines printed on the reverse pass. This can be done by using a CCD camera, for example, to capture the test pattern images and processing the images to measure the positions of the lines in the main scanning direction x.

In step S13, the deviation amounts δL, δS and δM thus measured are used to determine relative correction values which are then stored in PROM 43 in the printer 20. The relative correction value is the difference between the amount of deviation with respect to reference dots and the amount of deviation with respect to dots other than the reference dots. When large dots are used as the reference dots, relative correction value ΔS for small dots and relative correction value ΔM for medium dots are given by the following equations (6a) and (6b).

$$\Delta S=(\delta S-\delta L) \tag{6a}$$

$$\Delta M=(\delta M-\delta L) \tag{6b}$$

Instead of relative correction values ΔS, ΔM, the three deviation amounts δL, δS, δM may be stored in the printer PROM 43 by an operator. Thus, it does not matter as long as information is stored in the PROM that substantially expresses the relative correction values. It is not necessary to store relative correction values for all the dots other than the reference dot in the PROM 43, so long as there is at least one such value stored therein (ΔS, for example).

The test patterns for each of the dots may be comprised of multiple pairs of vertical lines. In such a case, the average value of printing position deviations between pairs of vertical lines formed of each type of dot by forward and reverse passes can be employed as the printing position deviation amount for the dots concerned. Instead of vertical lines, a pattern can be used comprised of straight lines formed by dots printed intermittently.

Moreover, a part of the test pattern may be printed in colored ink, meaning a color other than black, such as magenta, light magenta, cyan, light cyan, and so forth. For example, the large dot test pattern TPL could be printed in black ink and the small and medium test patterns TPS and TPM could be printed in color. In a color image, small and medium colored dots have a major effect on the quality of middle tone image portions. This means that the quality of middle tone image portions of color images can be improved by using colored inks to form small or medium dots and applying relative correction values to those dots.

In the third embodiment, the test pattern for determining a reference correction value, shown in FIG. 16, is formed of multiple pairs of vertical lines printed in black ink during forward and reverse passes.

Test pattern for determining a reference correction value is formed using the reference dots which is employed in determining relative correction values. This means that if the reference dots used in determining relative correction values is large magenta dots instead of large black dots, the test pattern for determining a reference correction value will also be formed using large magenta dots.

A test pattern that is to be used for adjustment by a user should be printed using large dots as the reference dots. This is advantageous in that it makes it easier for the user to perceive positional deviation in the test pattern, thereby enabling more accurate adjustment of the positional deviation.

Figure 26A:
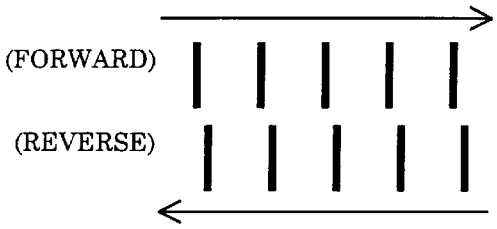
FIGS. 26(A)–26(D) illustrate the positional deviation correction implemented in the third embodiment.
Figure 26B:
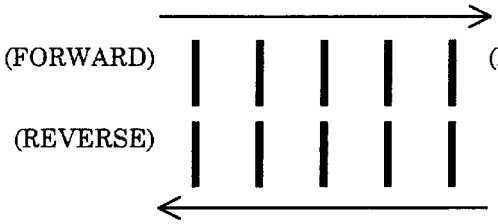
Figure 26C:
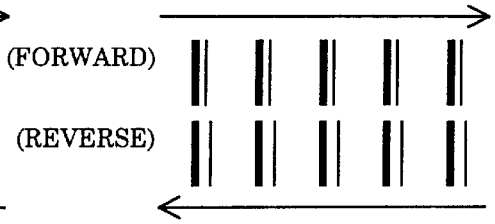
Figure 26D:
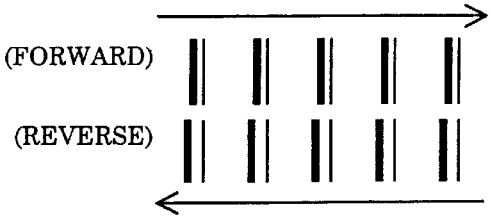

In the third embodiment, too, positional adjustment is implemented using the same configuration shown in FIG. 17 or FIG. 21. FIGS. 26(A)–26(D) illustrate the positional deviation adjustment implemented in the third embodiment. FIG. 26(A) shows deviation between vertical lines formed of large dots (reference dots) printed during forward and reverse passes without the adjusting to correct the positional deviation. FIG. 26(B) shows the hypothetical result of using a reference correction value to correct the positional deviation of the large dots. Thus, correction using the reference correction value eliminated positional deviation of the large dots arising during bidirectional printing. FIG. 26(C) shows vertical lines formed of large dots and lines formed of small dots, using the same adjustment condition as that used with respect to FIG. 26(B). In FIG. 26(C), deviation of the large dots has been eliminated but deviation of the small dots has not. In color images, the image quality of middle tone regions is particularly critical, and positional deviation of small dots has a greater effect on the image quality than that of large dots. FIG. 26(D) shows vertical lines formed of large dots that have been subjected to deviation adjustment based on both of the reference correction value and the relative correction value AS for small dots. In FIG. 26(D), positional deviation of the small dots is reduced, while deviation of the large dots has increased slightly. Thus, as revealed by FIG. 26(D), deviation of small dots can be decreased, thereby improving the quality of middle tone regions of color images, by using a reference correction value and a relative correction value to correct the positional deviation.

When medium dots have a greater effect on image quality than small dots, positional deviation can be corrected by using a relative correction value ΔM for medium dots. When small dots and medium dots have roughly the same effect on image quality, positional deviation can be corrected using a value that is the average Δave of the relative correction values for small and medium dots, given by equation (7).

$$\Delta ave=\{(\delta S-\delta L)+(\delta M-\delta L)\}/2=\{(\delta S+\delta M)/2\}-\delta L \quad (7)$$

As can be seen from equation (7), the average Δave of the relative correction values is the difference between the average of the deviation amounts δS, δM relating to the small and medium dots and the deviation amount 8L relating to the reference dots.

As can be understood from this example, relative correction values do not have to relate to target dots of one specific size, but can be averaged for application to multiple types of dots. The term "target dots" as used herein means one or multiple dots subject to positional deviation correction. Target dots can also include reference dots.

When printing in monochrome, positional deviation of large black dots can have a larger effect on image quality. As such, in monochrome printing it is preferable to correct positional deviation using only the reference correction value, as in FIG. 26(B). Therefore, a configuration is desirable whereby, when the computer 88 communicates to the printer control circuit 40 (actually, the deviation correction section 210 of FIG. 17) that a printing operation is monochrome printing, just a reference correction value is used to correct positional deviation during bidirectional printing, while when the printing is color printing, positional deviation during bidirectional printing is corrected using both reference and relative correction values.

When positional deviation of the reference large dots is particularly noticeable, even in the case of color printing, it is preferable to adjust the dot positions using the reference correction value itself. That is, the deviation correction section 210 can determine an adjustment value to correct the deviation in accordance with either a first adjustment mode in which an adjustment value is determined using reference and relative correction values, or a second adjustment mode in which the reference correction value itself is employed as an adjustment value.

As described in the foregoing, in accordance with this third embodiment an adjustment value for correcting positional deviation of small and medium dots is determined by correcting a large dot reference correction value with a relative correction value prepared in advance, thereby making it possible to improve the image quality of middle tone regions. When a user is making the positional adjustment, the test pattern used is formed of large dots, which has the advantage of facilitating accurate adjustment to correct the positional deviation.

Figure 27:
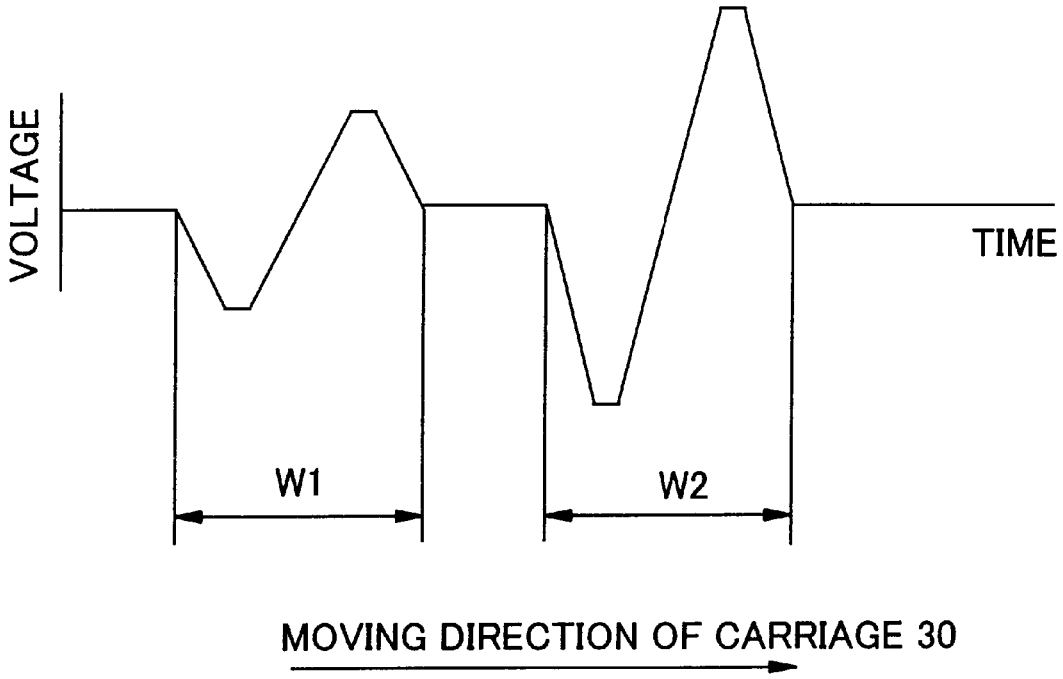
FIG. 27 shows a base drive signal waveform used in a fourth embodiment.

F. Fourth Embodiment (correction of positional deviation between dots of different sizes (2)):

FIG. 27 shows a base drive signal waveform used in a fourth embodiment. The base drive signal generates a small dot pulse W1 and a medium dot pulse W1 within one pixel period. When both of the small and medium dot pulses W1, W2 occur within one pixel period during the main scan, the small and medium ink droplets are put on the same pixel area to make a large dot. The order of the occurrence of the small and medium dot pulses W1, W2 is common in the forward and reverse passes.

Figure 28:
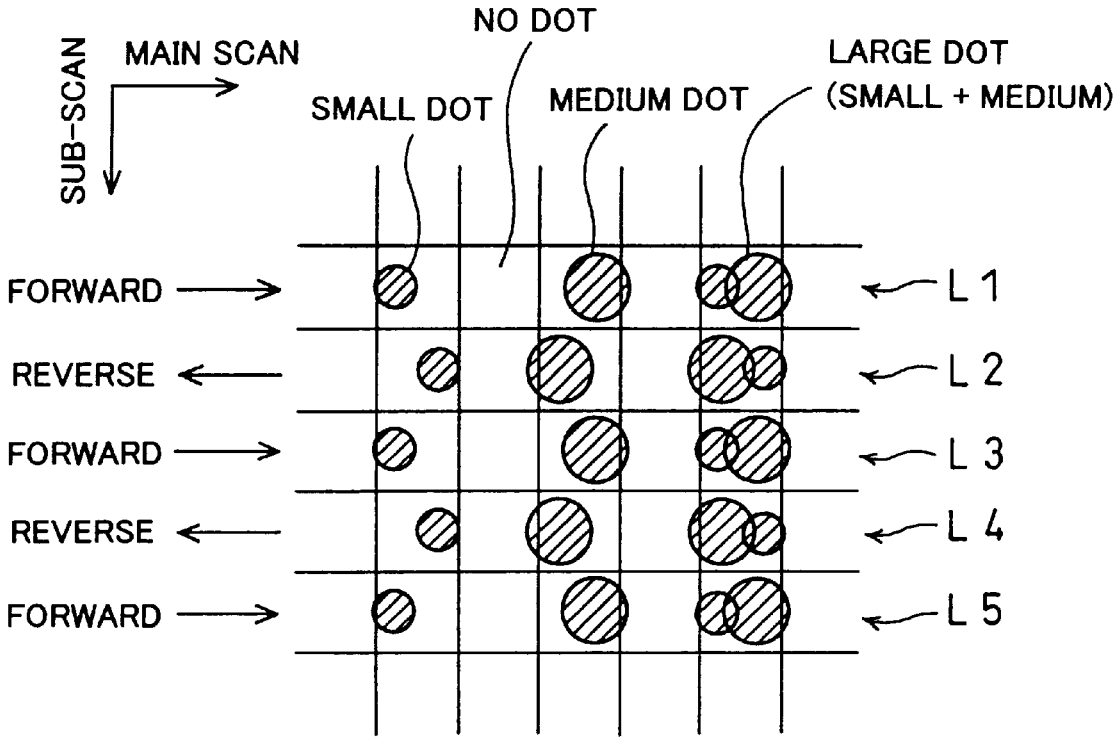
FIG. 28 illustrates deviation in the point of impact of ink droplets produced during bidirectional printing when positional adjustment has not been performed.

FIG. 28 shows the positional deviations of ink droplets in the main scanning direction when the recording positions of dots in the main scanning direction are not corrected. Since the order of occurrence of the drive signal pulses is common in the forward and reverse passes in the fourth embodiment, the positional deviation of ink droplets in the main scanning direction is greater than that of the third embodiment, as clearly shown in FIG. 28. The relatively small ink droplets are put on the left half in the respective pixel areas during the forward pass but on the right half during the reverse pass. On the contrary, the relatively large ink droplets are put on the right half in the respective pixel areas during the forward pass but on the left half during the reverse pass. The center of the positions of the large ink droplets are in the middle of those of the small dot and the medium dot.

FIGS. 29(*a*-1), 29(*a*-2), 29(*b*-1), and 29(*b*-2) show variations in the positional deviations between the forward and reverse passes with respect to the small and medium dots. FIG. 29(*a*-1) shows a variation in the positional deviation Δx with respect to the small dots in the main scanning direction. FIG. 29(*a*-2) shows the recording positions during the forward and reverse passes corresponding to FIG. 29(*a*-1). FIG. 29(*b*-1) shows a variation in the positional deviation Δx with respect to the medium dots in the main scanning direction. FIG. 29(*b*-2) shows the recording positions during the forward and reverse passes corresponding to FIG. 29(*b*-1). The solid vertical lines in FIGS. 10(*a*-2) and 10(*b*-2) are recorded during the forward pass and by the reverse pass. The horizontal arrow x represents the direction of the forward pass and corresponds to the direction of columns on printing paper sheet. In the description hereafter, the width of printing paper in the main scanning direction is referred to as the 'main scanning width' or the 'main scanning range'.

As shown by a solid curve in FIG. 29(*a*-1), the positional deviation Δx between the forward and reverse passes varies in the main scanning direction. This tendency is also found in the curve of FIG. 29(*b*-1). The variation in the positional deviation Δx in the main scanning direction is ascribed to the fact that the positional deviation Δx is affected by warpage of the platen. The positional deviation Δx is defined by subtracting the recording position during the reverse pass from the recording position during the forward pass. In this example, the positional deviation Δx in the main scanning direction with respect to the small dots varies in a negative range, whereas the positional deviation Δx in the main scanning direction with respect to the medium dots varies in a positive range. Some models of bidirectional printers have a variation in positional deviation with respect to the small dots in the positive range and a variation in positional deviation with respect to the medium dots in the negative range, contrary to the variations shown in FIGS. 10(*a*-1) and 10(*b*-i). The positional deviation with respect to the large dots is in the middle of the positional deviations with respect to the small dots and the medium dots.

Although the positional deviations with respect to the small dots, the medium dots, and the large dots are not identical with one another, the fourth embodiment applies an adjustment value for correcting the positional deviation with respect to the medium dots in common to all the three different types of dots. This is because the positional deviation between the forward and reverse passes is conspicuous in an image area having a medium tone of density, where the positional deviation with respect to the medium dots can be especially prominent.

Actually, the variation in positional deviation Δx as shown in FIG. 29 has different curves in the respective printers. The variation in positional deviation Δx is accordingly measured on the actual prints for the respective printers. A variety of methods are applicable to measure the variation in positional deviation Δx. By way of example, one applicable method causes the printer 22 to print an identical pattern (for example, a black and white stripe pattern) during the forward and reverse passes at the time of the assembly of the printer 22 and manually determines the positional deviation Δx based on the results of printing. Another applicable method attaches an optical reading device, such as a CCD camera, to the printer 22 and causes the printer 22 to print an identical pattern during the forward and reverse passes to automatically determine the positional deviation Δx. A mean positional deviation Δxave.l with respect to the medium dots is calculated from the variation in positional deviation Δx with respect to the medium dots thus obtained.

Figure 30:
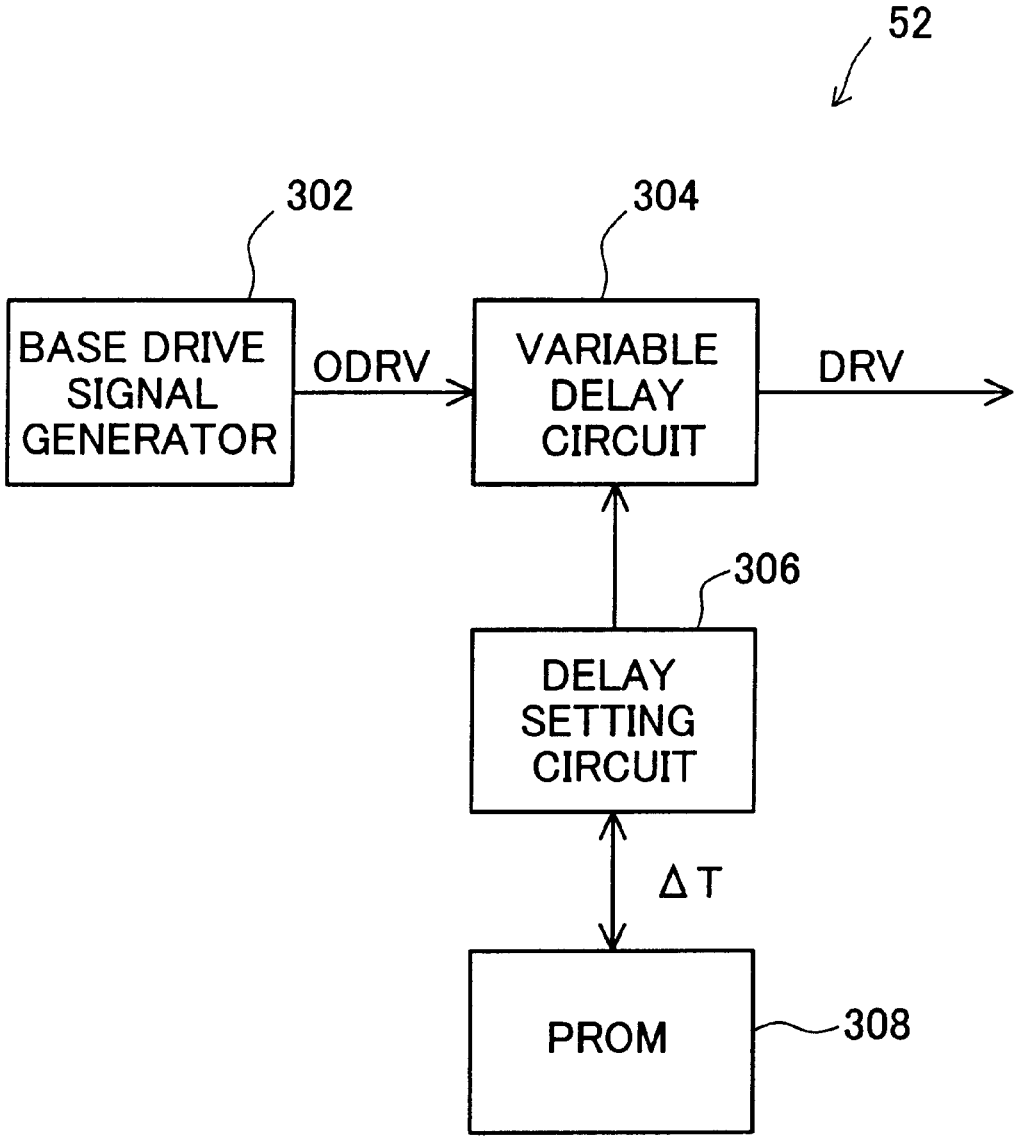
FIG. 30 is a block diagram of the internal configuration of the head drive circuit 52.

FIG. 30 is a block diagram illustrating the internal structure of the head drive circuit 52 in the fourth embodiment. The head drive circuit 52 includes an base drive signal generating circuit 302, a variable delay circuit 304, a delay setting circuit 306, and a programmable ROM (PROM) 308. The base drive signal generating circuit 302 generates a base drive signal ODRV having the waveform shown in FIG. 27. The base drive signal ODRV is delayed by the variable delay circuit 304 to produce a drive signal DRV, which is supplied to the print head 28. The delay setting circuit 306 has the function of setting a delay in the variable delay circuit 304.

The variable delay circuit 304 and the delay setting circuit 306 function as a recording position adjuster in a narrow sense, which adjust the base drive signal ODRV to change the recording positions of dots. The PROM 308 functions as a memory that stores the amount of adjustment for adjusting the recording positions.

A preset delay ΔT for correcting the positional deviation with respect to the medium dots has been registered in the PROM 308. The preset delay ΔT is used, for example, to set a specific amount of delay, which corresponds to the mean positional deviation Δxave.l shown in FIG. 29(*b*-1), in the variable delay circuit 304. Namely the preset delay ΔT is used to set a delay amount of Δxave.l/v, which is obtained by dividing the mean positional deviation Δxave.l by a driving speed v of the print head in the main scanning direction, in the variable delay circuit 304. The delay setting circuit 306 reads the preset delay ΔT from the PROM 308 and sets the delay amount in the variable delay circuit 304 based on the preset delay ΔT.

The adjustment of delay with respect to the base drive signal ODRV is carried out for at least one of the forward and reverse passes. For example, in the event that the positional deviations as shown in FIGS. 10(*b*-1) and 10(*b*-2) are corrected, the delay amount with respect to the base drive signal ODRV is adjusted to cause ink to be emitted from the print head 28 Δxave.l/v earlier than the non-adjusted timing in the reverse pass. Since the timings of ink emission during the forward and reverse passes are to be adjusted in a relative manner, the delay of the base drive signal ODRV may be set respectively in the forward pass and in the reverse pass to correct the positional deviation.

Any appropriate value other than the mean positional deviation within the main scan range may be used for the correction value for correcting the positional deviation. For example, the average of the maximum positional deviation and the minimum positional deviation may be used for the correction value for correcting the positional deviation.

The correction value (or the adjustment value) for correcting the positional deviation with respect to the medium dots of the black ink is commonly applied to the three different sizes of dots of all the six different color inks. This reduces the positional deviations in the medium tone range and thereby improves the image quality especially in the image area of the medium tone.

Although the positional deviation correction is achieved by adjusting delay of the drive signal DRV, it can be also achieved by adjusting the generation timing of the pulses of the base drive signal ODRV in the base drive signal generating circuit 302. In general, the generation timing of the pulses of the drive signal DRV may be adjusted during at least one of the forward and reverse passes so that the positional deviation with respect to the medium dots is reduced.

Figures 31A, 31B, 31C, 31D, 31E:
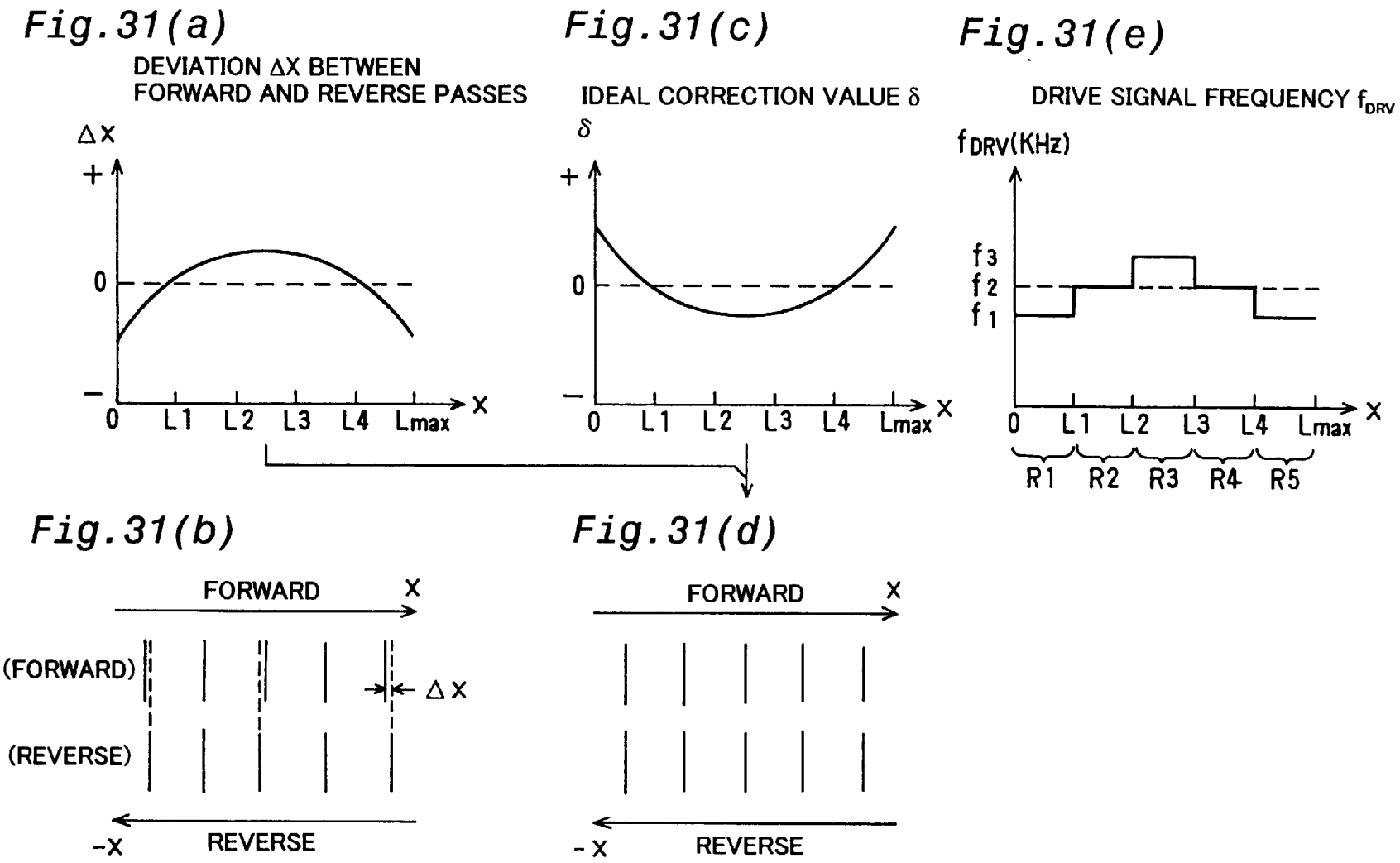
FIGS. 31(*a*)–31(*e*) illustrate a method of adjusting the position of dots printed in the main scanning direction by adjusting the frequency of the drive signal ODRV.

G. Fifth Embodiment (correction of positional deviation by adjustment of drive signal frequency):

Instead of delaying the drive signal DRV as in the fourth embodiment, the fifth embodiment adjusts the frequency of the drive signal DRV to adjust the generation timing of the pulses of the drive signal DRV and thereby reduce the positional deviation of dots. FIGS. 31(*a*)–31(*e*) show a method of adjusting the frequency of the drive signal DRV to reduce the positional deviation of dots in the fifth embodiment. FIG. 31(*a*) shows a variation in positional deviation Δx in the main scanning direction without any correction. FIG. 31(*b*) shows the positional deviation between the forward and reverse passes corresponding to the state of FIG. 31(*a*). In the graph of FIGS. 31(*a*), an extreme case is assumed that the positional deviation Δx shows a concave variation and takes positive values on about the center of the main scanning width Lmax and negative values on both ends thereof.

FIG. 31(*c*) shows a variation in ideal correction value δ for correcting the positional deviation shown in FIG. 31(*a*). FIG. 31(*d*) shows the recording positions during the forward and reverse passes when the correction has been done to make the positional deviation Δx substantially equal to zero. The variation in ideal correction value δ is the minus of the variation in positional deviation Δx shown in FIG. 31(*a*).

FIG. 31(*e*) shows a variation in frequency $f_{DRV}$ of the drive signal DRV used for correcting the deviation of the recording positions in the fifth embodiment. The main scanning width Lmax is divided into five ranges R1 through R5 of substantially equal widths, and the frequency $f_{DRV}$ of the drive signal DRV is set individually for each range. L1 through L4 denote the positions of the boundaries between the respective ranges. In the ranges R2 and R4 where the correction value δ is fairly close to zero as shown in FIG. 31(*c*), a standard value $f_2$ is set to the frequency $f_{DRV}$. In the range R3 where the correction value δ takes negative values, a value $f_3$ greater than the standard value $f_2$ is set to the frequency $f_{DRV}$. In the ranges R1 and R5 where the correction value δ takes positive values, a value $f_1$ smaller than the standard value $f_2$ is set to the frequency $f_{DRV}$. The timing of emitting ink droplets from the print head 28 depends upon the frequency of the drive signal DRV. The higher frequency $f_{DRV}$ shortens the cycle of ink emission and decreases the distance between dots recorded in the main scanning direction. The relationship between the change of the recording positions of dots due to the variation of the frequency $f_{DRV}$ and the correction of the positional deviation will be discussed later.

The positional correction with almost the ideal correction value δ can be attained by setting the frequency $f_{DRV}$ of the drive signal DRV individually for each of the plurality of divided ranges of the main scan range as shown in FIG. 31(*e*). According to the ability of the head drive circuit 54 (see FIG. 3), the frequency of the drive signal DRV may be changed continuously. The stepwise change of the frequency $f_{DRV}$ as shown in FIG. 31(*e*), however, advantageously simplifies the circuit structure.

The positional deviation Δx can be reduced to substantially zero by applying the change of the frequency $f_{DRV}$ as shown in FIG. 31(*e*) during the reverse pass while keeping the frequency $f_{DRV}$ to a fixed value (for example, the standard value $f_2$) during the forward pass. In another available procedure, on the contrary, the frequency $f_{DRV}$ is adjusted during the forward pass while keeping the frequency $f_{DRV}$ to a fixed value during the reverse pass. In still another available procedure, the frequency $f_{DRV}$ may be adjusted during both the forward and reverse passes. In general, the frequency $f_{DRV}$ of the drive signal DRV may be adjusted according to the recording positions in the main scanning direction during at least one of the forward and reverse passes.

The frequency of the main scan drive signal for driving the carriage motor 24 is kept to a fixed value during both the forward and reverse passes. The variation in frequency $f_{DRV}$ of the drive signal DRV as shown in FIG. 31(*e*) accordingly changes the recording positions in the main scanning direction. The method of changing the frequency of the main scan drive signal also effects correction of the deviation of the recording positions in the course of bidirectional printing.

The following describes the relationship between the change of the recording positions of dots due to the adjustment of the frequency $f_{DRV}$ and the correction of the positional deviation. As described previously, the higher frequency $f_{DRV}$ causes the smaller distance between dots in the main scanning direction. In the first and the fifth ranges R1 and R5 in FIG. 31(*e*), the frequency $f_{DRV}$ is relatively low, which causes a relatively large distance between dots. The recording positions during the reverse pass are accordingly shifted in the minus x direction, compared with those in FIG. 31(*b*). In the third range R3, on the other hand, the frequency $f_{DRV}$ is relatively high, which causes a relatively small distance between dots. The recording positions during the reverse pass are accordingly shifted in the plus x direction, compared with those in FIG. 31(*b*). This results in correcting the recording positions during the reverse pass and causes the recording positions during the reverse pass to coincide substantially with the recording positions during the forward pass. The frequency $f_{DRV}$ would vary like the graph of FIG. 31(*e*) in the case where the frequency $f_{DRV}$ is adjusted for the forward pass.

Figure 32:
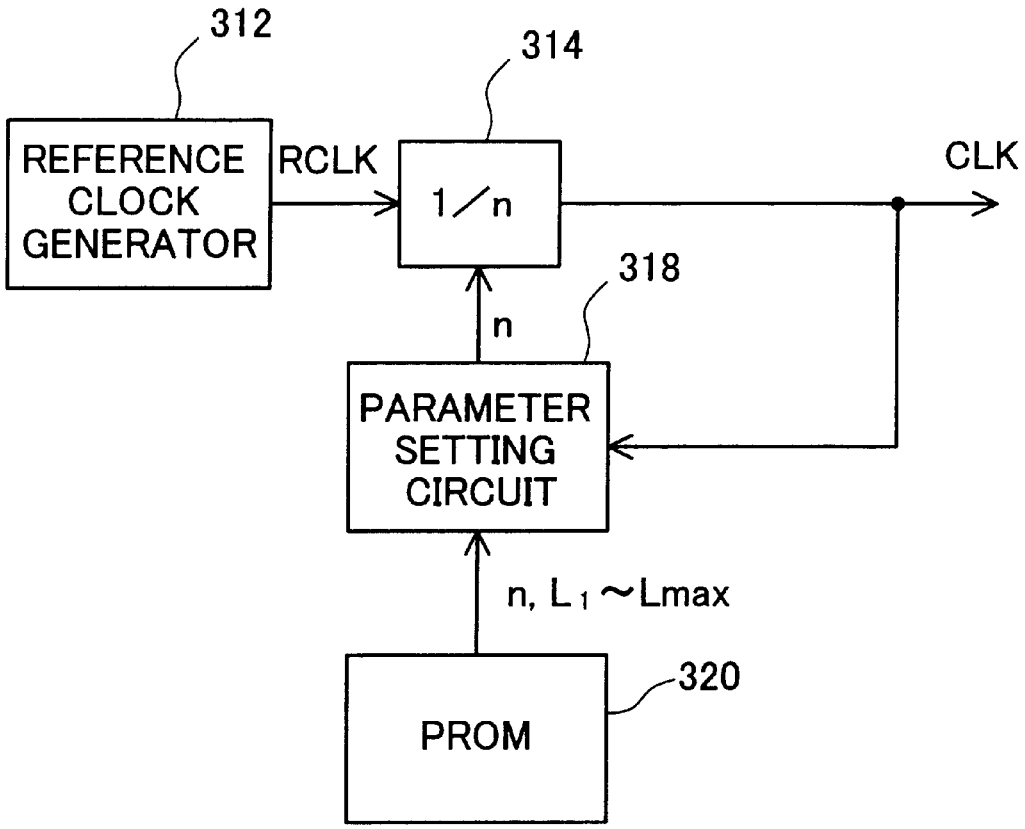
FIG. 32 is a block diagram showing the configuration of the clock generator circuit used in the base drive signal generator circuit 302.

FIG. 32 is a block diagram of a circuit for generating a clock signal used in generating the base drive signal ODRV. The clock generating circuit includes a reference clock generating circuit 312, a frequency divider 314, a parameter setting circuit 318, and a PROM 320. A reference clock signal RCLK generated by the reference clock generating circuit 312 is divided by n by the frequency divider 314 to produce a clock signal CLK. The base drive signal generating circuit 302 (FIG. 30) generates the base drive signal ODRV having the waveform as shown in FIG. 27 in synchronousm with the clock signal CLK. Regulation of the frequency of the clock signal CLK thus effects the adjustment of the frequencies of the base drive signal ODRV and the drive signal DRV.

PROM 120 stores the values of frequency division ratio n in the respective ranges R1 through R5 and the positions of boundaries L1 through Lmax between the respective ranges (or the widths of the respective ranges). The parameter setting circuit 318 changes the settings of the frequency division ratio n in the frequency divider 314, so as to attain the frequency change as shown in FIG. 31(*e*). The parameter setting circuit 318 has a counter (not shown) that counts the number of pulses of the clock signal CLK supplied from the frequency divider 314. Based on the comparison between the count on the counter and the positions of the boundaries L1 through Lmax between the respective ranges (or the comparison between the count and the widths of the respective ranges), the parameter setting circuit 318 determines which of the five ranges R1 through R5 is the current main scanning position of the carriage 30. The position of the origin of the carriage 30 is previously set in response to a signal supplied from the position sensor 39 (see FIG. 1) to the control circuit 40. The parameter setting circuit 318 reads the frequency division ratio n corresponding to the specific range that includes the current main scanning position of the carriage 30 and sets the corresponding frequency division ratio n in the frequency divider 314.

The clock generating circuit shown in FIG. 32 specifies the frequency division ratio n, which is used in dividing the frequency of the reference clock signal RCLK, in each range and thereby readily generates the clock signal CLK having the frequency suitable for the respective ranges. The drive signal DRV having the same frequency as that of the clock signal CLK is then generated in response to the clock signal CLK.

H. Modifications:

H1. Modification 1:

With respect to using reference and relative correction values to correct positional deviation during bidirectional printing by a printer in which the carriage may be moved at different main scanning velocities (or different carriage speeds), it is preferable that a relative correction value relating to a row of nozzles should be set for each such main scanning velocity. As can be understood from the explanation made with reference to FIG. 9, changing the main scanning velocity Vs also changes the degree of relative positional deviation between the rows of nozzles. As such, setting a relative correction value for each main scanning velocity makes it possible to achieve a further decrease in positional deviation during bidirectional printing.

H2. Modification 2:

With respect to using reference and relative correction values to correct positional deviation during bidirectional printing by a multilevel printer able to print dots of the same color in different sizes, it is preferable to set a relative correction value for each dot size. Setting a relative correction value for each dot size makes it possible to achieve a further decrease in positional deviation during bidirectional printing. Sometimes a multilevel printer is only able to form only dots of the same size in one main scanning pass with one row of nozzles. When this is the case, a dot size is selected for each main scanning pass, so with respect also to the relative correction value used to correct the positional deviation, for each main scanning pass a suitable value is selected in accordance with the dot size concerned.

Moreover, with respect to a printing operation that produces dots of different sizes, it is possible to use printing modes that emit ink at mutually different velocities. Such a modification would mean setting relative correction values with respect to each of the multiple modes in which dots are formed using ink emitted at different velocities.

H3. Modification 3:

In the case of the first and second embodiments it is preferable to set relative correction values independently for each row of nozzles other than the reference row of nozzles. This makes it possible to further decrease positional deviation. Relative correction values can also be separately set for each group of nozzle rows that emit ink of the same color. For example, if the head is provided with two rows of nozzles that emit a specified ink, the same relative correction value can be applied to the nozzles of both rows.

H4. Modification 4:

In the first to third embodiments the row of black ink nozzles is selected as the reference row of nozzles when determining the reference and relative correction values. However, it is also possible to select a different row of nozzles as the reference. However, selecting a low density color ink such as light cyan or light magenta makes it harder for a user to read the test pattern used during determination of a reference correction value. Therefore, it is preferable to select as the reference a row of nozzles used to emit a relatively high density ink (black, dark cyan, dark magenta).

H5. Modification 5:

When the positional deviations of cyan and magenta are to be made equal to each other in color printing, the following simple method can be applied in place of the method using the reference and relative correction values described in the first to third embodiments. In the simple method, one of cyan and magenta inks is used to print vertical lines of the test pattern shown in FIG. 16 in the forward pass, and the other ink is used to print vertical lines in the reverse pass. An appropriate adjustment value is indicated by the deviation adjustment number for the line pair whose positions in the main scanning direction coincide with each other. In this method, an appropriate adjustment value to make the positional deviations of cyan and magenta equal to each other can be readily determined by printing a single test pattern as shown in FIG. 16.

H6. Modification 6:

In the first to third embodiments positional deviation is corrected by adjusting the position (or timing) at which dots are printed. However, positional deviation may be corrected by other methods, for example by delaying the drive signals to the actuator chips or by adjusting the frequency of the drive signals.

H7. Modification 7:

The third and fourth embodiments are able to use a single nozzle to print dots of three different sizes at a single pixel position. Normally this concept can be applied to a printer that with respect to at least one ink, can use one nozzle to print N sizes of dots (where N is an integer of 2 or more) at each pixel position. In this case, as the target dots for adjustment to correct positional deviation, there can be selected at least one dot including dots other than the largest among the N types of dots. The value of the adjustment used to correct deviation of the target dots can be applied in common to the N types of dots.

Dots that can be selected as target dots include the smallest among the N types of dots and, also dots of a medium size. Selecting these as the target dots would improve the quality of middle tone image regions.

"[A] medium size dot among N types of dots" refers to a dot of size (N+1)/2 when N is an odd number, and to dots of size N/2 or (N/2+1) when N is an even number. Instead, as medium sized dots, there may be employed the dots that are used in the greatest numbers when the image signal indicates a density level of 50%.

H8. Modification 8:

In each of the foregoing embodiments positional deviation is corrected by adjusting the positioning (or timing) of dots printed during a reverse pass. However, positional deviation may be corrected by adjusting the positioning of dots printed during a forward pass, or by adjusting the positioning of dots printed during forward and reverse passes. Thus, all that matters is that the positions at which dots are printed be adjusted during at least one selected from a forward pass and a reverse pass.

H9. Modification 9:

The above embodiments are each described with respect to an inkjet printer. However, the present invention is not limited thereto and may be applied to any of various printers that print using a print head. Similarly, the present invention is not limited to an apparatus or method for emitting ink droplets, but can also be applied to apparatuses and methods used to print dots by other means.

H10. Modification 10:

While the configurations of the above embodiments have been implemented in terms of hardware, the configurations may be partially replaced by software. Conversely, software-based configurations may be partially replaced by hardware. For example, some of the functions of the head drive circuit 52 shown in FIG. 12 may be implemented in software.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A bidirectional printing apparatus that bidirectionally prints images on a print medium during forward and reverse main scanning passes in accordance with print image signals, the apparatus comprising:

a print head able to print plural types of dots at each pixel position on the print medium, the plural types of dots being different at least in density;

a main scanning drive section that effects bidirectional main scanning by moving at least one selected from the print medium and the print head;

a sub-scanning drive section that effects sub-scanning by moving at least one selected from the print medium and the print head;

a head drive section that supplies drive signals to the print head to effect printing on the print medium; and a controller for controlling bidirectional printing, the controller having a printing position adjuster that reduces printing positional deviation arising between forward and reverse main scanning passes with an adjustment value, the adjustment value being set with respect to at least one type of specific target dots other than those dots having the highest density out of the plural types of dots.

2. The bidirectional printing apparatus according to claim 1, wherein the print head is able to print dots in each of M types of inks where M is an integer of at least two;

the target dots are formed of specific inks having a relatively low density out of the M types of inks; and the printing position adjuster adjusts the printing positions using the adjustment value relating to the target dots in color printing using two or more of the M types of inks.

3. The bidirectional printing apparatus according to claim 2, wherein the M types of inks include at least one pair of dark and light inks having substantially the same hue and different densities and the target dots are formed of the light ink.

4. The bidirectional printing apparatus according to claim 3, wherein the M types of inks include a pair of dark and light inks for each of cyan and magenta, the target dots include first target dots formed of light cyan ink and second target dots formed of light magenta ink, and the adjustment value is determined such that a positional deviation of the first target dots and a positional deviation of the second target dots become substantially equal.

5. The bidirectional printing apparatus according to claim 1, wherein the print head can print N types of dots of different sizes in at least one type of ink where N is an integer of at least 2, the target dots include at least one type of relatively small dots other than the largest among the N types of dots; and the adjustment value with respect to the relatively small target dots is applied in common to the N types of dots.

6. The bidirectional printing apparatus according to claim 5, wherein the target dots are those that are medium sized of the N types of dots.

7. The bidirectional printing apparatus according to claim 6, wherein the target dots are dots that are used in the greatest numbers when the printing image signal indicates a density level of 50% in respect of ink used to form the target dots.

8. The bidirectional printing apparatus according to claim 1, wherein the printing position adjuster adjusts the timing of the generated drive signal pulses during at least one selected from a forward pass and a reverse pass to reduce positional deviation in a main scanning direction between target dots printed during the forward and reverse passes.

9. The bidirectional printing apparatus according to claim 8, wherein the printing position adjuster adjusts the timing of the generated drive signal pulses by delaying the drive signal during at least one selected from a forward pass and a reverse pass.

10. The bidirectional printing apparatus according to claim 8, wherein the printing position adjuster adjusts the timing of the generated drive signal pulses by changing the frequency of the drive signal in accordance with a position in the main scanning direction, with the frequency adjustment taking place during at least one selected from a forward pass and a reverse pass.

11. A method of bidirectional printing using a print head able to print plural types of dots at each pixel position on a print medium during forward and reverse main scanning passes in accordance with print image signals, the plural types of dots being different at least in density, the method comprising the steps of:

(a) preparing an adjustment value with respect to at least one type of specific target dots other than those dots having the highest density out of the plural types of dots; and (b) adjusting printing positions during forward and reverse main scanning passes with the adjustment value to reduce printing positional deviation between forward and reverse main scanning passes.

12. The bidirectional printing method according to claim 11, wherein the print head is able to print dots in each of M types of inks where M is an integer of at least two;

the target dots are formed of specific inks having a relatively low density out of the M types of inks; and the step (b) includes the step of adjusting the printing positions using the adjustment value relating to the target dots in color printing using two or more of the M types of inks.

13. The bidirectional printing method according to claim 12, wherein the M types of inks include at least one pair of dark and light inks having substantially the same hue and different densities and the target dots are formed of the light ink.

14. The bidirectional printing method according to claim 13, wherein the M types of inks include a pair of dark and light inks for each of cyan and magenta, the target dots include first target dots formed of light cyan ink and second target dots formed of light magenta ink, and the adjustment value is determined such that a positional deviation of the first target dots and a positional deviation of the second target dots become substantially equal.

15. The bidirectional printing method according to claim 11, wherein the print head can print N types of dots of different sizes in at least one type of ink where N is an integer of at least 2, the target dots include at least one type of relatively small dots other than the largest among the N types of dots; and the adjustment value with respect to the relatively small target dots is applied in common to the N types of dots.

16. The bidirectional printing method according to claim 15, wherein the target dots are those that are medium sized of the N types of dots.

17. The bidirectional printing method according to claim 16, wherein the target dots are dots that are used in the greatest numbers when the printing image signal indicates a density level of 50% in respect of ink used to form the target dots.

18. The bidirectional printing method according to claim 11, wherein the step (b) includes the step of adjusting the timing of the generated drive signal pulses during at least one selected from a forward pass and a reverse pass to reduce positional deviation in a main scanning direction between target dots printed during the forward and reverse passes.

19. The bidirectional printing method according to claim 18, wherein the step (b) further includes the step of adjusting the timing of the generated drive signal pulses by delaying the drive signal during at least one selected from a forward pass and a reverse pass.

20. The bidirectional printing method according to claim 18, wherein the step (b) further includes the step of adjusting the timing of the generated drive signal pulses by changing the frequency of the drive signal in accordance with a position in the main scanning direction, with the frequency adjustment taking place during at least one selected from a forward pass and a reverse pass.

21. A computer program product for causing a computer comprising a printing apparatus to execute bidirectional printing, the printing apparatus being able to print plural types of dots at each pixel position on a print medium during forward and reverse main scanning passes in accordance with print image signals, the plural types of dots being different at least in density, the computer program product comprising:

a computer readable medium; and a computer program stored on the computer readable medium, the computer program causing a computer to adjust printing positions during forward and reverse main scanning passes with an adjustment value to reduce printing positional deviation between forward and reverse main scanning passes, wherein the adjustment value has been prepared with respect to at least one type of specific target dots other than those dots having the highest density out of the plural types of dots.

* * * * *